US009718117B2

(12) United States Patent
Miyashita

(10) Patent No.: US 9,718,117 B2
(45) Date of Patent: Aug. 1, 2017

(54) FORGING METHOD AND FORGING APPARATUS

(71) Applicant: Showa Denko K.K., Tokyo (JP)

(72) Inventor: Ichitami Miyashita, Fukushima (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 15/172,281

(22) Filed: Jun. 3, 2016

(65) Prior Publication Data

US 2016/0354835 A1 Dec. 8, 2016

(30) Foreign Application Priority Data

Jun. 4, 2015 (JP) ..... 2015-113967

(51) Int. Cl.
*B21J 9/20* (2006.01)
*B21J 5/02* (2006.01)
*B21J 5/00* (2006.01)

(52) U.S. Cl.
CPC ..... *B21J 9/20* (2013.01); *B21J 5/006* (2013.01); *B21J 5/02* (2013.01)

(58) Field of Classification Search
CPC ..... B21J 5/02; B21J 5/022; B21J 5/04; B21J 5/06; B21J 5/063; B21J 9/20; B21J 5/006; G01B 5/02; B21D 51/26
See application file for complete search history.

(56) References Cited

U.S. PATENT DOCUMENTS 4,854,149 A * 8/1989 Porucznik ..... B21D 51/2615 413/69
5,095,733 A * 3/1992 Porucznik ..... B21D 51/26 72/347

FOREIGN PATENT DOCUMENTS

JP 2681603 B2 8/1997
JP 2000-42490 A 2/2000
JP 2009-279596 A 12/2009

OTHER PUBLICATIONS

Fundamental Research on Ultrasonic Micro-coining (4th Report)—Consideration on Processing Characteristics—Partial Translation)—56th Plastic Shaping Association Lecture Presentation (Nov. 18, 2005).
English Abstract of JP H 07-132368 A published May 23, 1995.
English Abstract of JP 2000-042490 A published Feb. 15, 2000.
English Abstract of JP 2009-279596 A published Dec. 3, 2009.

* cited by examiner

*Primary Examiner* — Moshe Wilensky
*Assistant Examiner* — Pradeep C Battula
(74) *Attorney, Agent, or Firm* — Millen, White, Zelano & Branigan, P.C.; William Nixon

(57) ABSTRACT

A forging method is set in a shaping hole of a die body, and the forging material is pressed with a punch to perform plastic shaping of the forging material. Ultrasonic vibration having a vibration frequency is applied to the die body with a vibration applying apparatus during the plastic shaping of the forging material. The vibration frequency is converged to a resonance frequency of the die body when the vibration frequency is within a tracking range of the vibration applying apparatus during the plastic shaping of the forging material. When the tracking range is shifted in accordance with a discontinuous change of the resonance frequency during the plastic shaping of the forging material to deviate from the vibration frequency, the reference frequency is changed so as to fall within a shifted tracking range.

7 Claims, 13 Drawing Sheets

FORGING METHOD AND FORGING APPARATUS

CROSS-REFERENCE TO THE RELATED APPLICATIONS

The present application claims priority to Japanese Patent Application No. 2015-113967 filed on Jun. 4, 2015, the entire disclosure of which is incorporated herein by reference in its entirety.

BACKGROUND OF THE INVENTION

Technical Field

Some embodiments of the present invention relate to a forging method and a forging apparatus that performs forging while applying ultrasonic vibration to a die.

Description of the Related Art

The following description of related art sets forth the inventors' knowledge of related art and certain problems therein and should not be construed as an admission of knowledge in the prior art.

Conventionally, ultrasonic forging is publicly known in which ultrasonic vibration is applied to a shaping die during the shaping operation in performing forging. In the ultrasonic forging, as described in a Non-Patent Document (Masahiko Jin, "Fundamental Study on Ultrasonic Micro Coining (Ver. 4)." "56$^{th}$ Plastic Shaping Association Lecture Presentation Lecture Collection of Paper." 2005, p. 583-584" or Patent Document 1 (Japanese Unexamined Patent Application Publication No. 2009-279596), it is possible to decrease a shaping load and/or improve a shape transfer property.

Such a forging apparatus for performing ultrasonic forging is provided with a die assembly including a die and a punch, a vibrator attached to the die, and an ultrasonic vibration device that drives the vibrator. At the time of applying a pressure to a forging material in the die with the punch, the vibrator is driven by the output from the ultrasonic vibration device to apply ultrasonic vibration to the die.

On the other hand, in the aforementioned forging apparatus, it is adjusted so that the vibrator is driven at the resonance frequency of the die by the ultrasonic vibration device. For example, as described in Patent Document 2 (Japanese Unexamined Patent Application Publication No. 2000-42490), Patent Document 3 (Japanese Patent No. 2681603), etc., an ultrasonic vibration device is provided with a tracking function. An initial value (reference frequency) of the vibration frequency by the ultrasonic vibration device is set near the resonance frequency, and the vibration frequency is converged to the resonance frequency by the tracking function to vibrate the die in the resonant condition.

By the way, when the present inventors were performing ultrasonic forging using the aforementioned forging apparatus, it was confirmed that there is a case in which the die does not vibrate at the resonance frequency and does not vibrate with a sufficient amplitude regardless that the ultrasonic vibration device is equipped with a tracking function. As a result, this caused problems that it was difficult to, for example, assuredly decrease the shaping load and improve the shape transfer property (formability of minute shape).

The description herein of advantages and disadvantages of various features, embodiments, methods, and apparatus disclosed in other publications is in no way intended to limit the present disclosure. For example, certain features of the preferred described embodiments of the disclosure may be capable of overcoming certain disadvantages and/or providing certain advantages, such as, e.g., disadvantages and/or advantages discussed herein, while retaining some or all of the features, embodiments, methods, and apparatus disclosed therein.

SUMMARY OF THE INVENTION

Some embodiments of the present invention have been developed in view of the above-mentioned and/or other problems in the related art. The embodiments in this disclosure can significantly improve upon existing methods and/or apparatuses.

Some embodiments of the present invention were made in view of the aforementioned problems.

An object of some embodiments of the present invention is to provide a forging method capable of accurately vibrating a die body at a resonance frequency and also capable of assuredly attaining effects due to vibration application, such as, e.g., decreasing of a shaping load and improving of a shape transfer property.

Another object of some embodiments of the present invention is to provide a forging apparatus capable of accurately vibrating a die body at a resonance frequency and also capable of assuredly attaining effects due to vibration application, such as, e.g., decreasing of a shaping load and improving of a shape transfer property.

The other purposes and advantages of some embodiments of the present disclosure will be made apparent from the following preferred embodiments.

In order to attain the aforementioned objects, the present inventors made a keen effort to investigate in detail about the cause of hindering the vibration at the resonance frequency during the forging process by ultrasonic forging.

The investigation revealed that the die resonance frequency changes during the forging process in the ultrasonic forging, and the die resonance frequency sometimes changes discontinuously (in a stepwise fashion) depending on, e.g., the condition of the forging material. It was also revealed that such a discontinuous change of resonance frequency causes shifting of the tracking range in accordance with the resonance frequency change, resulting in deviation of the tracking range from the vibration frequency of the ultrasonic vibration device. As a result, the vibration frequency of the ultrasonic vibration device fails to converge to the resonance frequency, but converges to another frequency, which disables vibration of the die in a resonance condition.

Further, the present inventors repeatedly performed careful experiments and studies, and found a structure capable of attaining the aforementioned objects, and completed the present invention.

That is, the present invention has the following structure.

[1] According to a first aspect of some embodiments of the present invention, a forging method includes: setting a forging material in a shaping hole of a die body; pressing the forging material with a punch to perform plastic shaping of the forging material; applying ultrasonic vibration having a reference frequency as an initial value of a vibration frequency to the die body with a vibration applying apparatus during the plastic shaping of the forging material; and converging the vibration frequency to a resonance frequency of the die body during the plastic shaping of the forging material when the vibration frequency is within a tracking range of the vibration applying apparatus. When the tracking range is shifted in accordance with a discontinuous change of the resonance frequency during the plastic shaping of the forging material to deviate from the vibration frequency, the reference frequency is changed so as to fall within a shifted tracking range.

[2] In the forging method as recited in the aforementioned Item [1], it may be configured such that the vibration applying apparatus has a tracking function of converging the vibration frequency to the resonance frequency of the die body when the vibration frequency is within the tracking range, and the vibration applying apparatus is configured to change the reference frequency so as to fall within the shifted tracking range.

[3] In the forging method as recited in the aforementioned Item [1] or [2], it may be configured such that a contact state of the forging material with respect to a shaping hole inner peripheral surface of the die body changes during the plastic shaping of the forging material from an insufficient contact state to a sufficient contact state, and the reference frequency is changed after shifting of the contact state from the insufficient contact state to the sufficient contact state.

[4] In the forging method as recited in any one of the aforementioned Items [1] to [3], it may be configured such that the forging material is extruded rearward so as to be filled into a punch outer peripheral gap between a punch outer peripheral side surface and a shaping hole inner peripheral surface of the die body during the plastic shaping of the forging material, a contact state of the forging material with respect to the punch outer peripheral side surface changes during a process that the forging material is being filled in the punch outer peripheral gap from an insufficient contact state to a sufficient contact state, and the reference frequency is changed after shifting of the contact state of the forging material with respect to punch outer peripheral side surface from the insufficient contact state to the sufficient contact state.

[5] In the forging method as recited in any one of the aforementioned Items [1] to [4], it may be configured to further include: obtaining a time of shifting a contact state of the forging material with respect to a shaping hole inner peripheral surface of the die body from an insufficient contact state to a sufficient contact state based on an elapsed time from a start time of the plastic shaping of the forging material by the punch; and determining a time of changing the reference frequency based on the obtained time.

[6] In the forging method as recited any one of the aforementioned Items [1] to [5], it may be configured to further include: obtaining a punch load at a time of shifting of a contact state of the forging material with respect to a shaping hole inner peripheral surface of the die body to a sufficient contact state; and determining a time of changing the reference frequency based on the obtained punch load.

[7] In the forging method as recited any one of the aforementioned Items [1] to [6], it may be configured to further include: obtaining a time of shifting of the contact state from the insufficient contact state to the sufficient contact state based on an elapsed time from a start time of the plastic shaping of the forging material by the punch; and determining a time of changing the reference frequency based on the obtained time.

[8] In the forging method as recited any one of the aforementioned Items [1] to [7], it may be configured to further include: obtaining a punch load at a time of shifting of the contact state from the insufficient contact state to the sufficient contact state; and determining a time of changing the reference frequency based on the obtained punch load.

[9] In the forging method as recited any one of the aforementioned Items [1] to [8], it may be configured such that application of vibration by the vibration applying apparatus is stopped immediately before changing the reference frequency, and the application of vibration by the vibration applying apparatus is restarted when the reference frequency is changed.

[10] According to a second aspect of some embodiments of the present invention, a forging apparatus includes: a die body having a shaping hole; a punch configured to be driven into the shaping hole to perform plastic shaping of a forging material in the shaping hole; and a vibration applying apparatus configured to apply ultrasonic vibration having a reference frequency as an initial value of a vibration frequency to the die body. The vibration applying apparatus is configured to change the reference frequency during the plastic shaping of the forging material.

[11] In the forging apparatus as recited in the aforementioned Item [10], it may be configured such that the vibration applying apparatus is configured to converge the vibration frequency to a resonance frequency of the die body during the plastic shaping of the forging material when the vibration frequency is within a tracking range of the vibration applying apparatus.

[12] In the forging apparatus as recited in the aforementioned Item [10] or [11], it may be configured such that a contact state of the forging material with respect to a shaping hole inner peripheral surface of the die body changes during the plastic shaping of the forging material from an insufficient contact state to a sufficient contact state, and the vibration applying apparatus is configured to change the reference frequency after shifting of the contact state from the insufficient contact state to the sufficient contact state.

[13] In the forging apparatus as recited in any one of the aforementioned Items [10] to [12], it may be configured such that the forging material is extruded rearward so as to be filled into a punch outer peripheral gap between a punch outer peripheral side surface and a shaping hole inner peripheral surface of the die body during the plastic shaping of the forging material, a contact state of the forging material with respect to the punch outer peripheral side surface changes during a process that the forging material is being filled in the punch outer peripheral gap from an insufficient contact state to a sufficient contact state, and the vibration applying apparatus is configured to change the reference frequency after shifting of the contact state of the forging material with respect to the punch outer peripheral side surface from the insufficient contact state to the sufficient contact state.

[14] In the forging apparatus as recited in any one of the aforementioned Items [10] to [13], it may be configured such that, when the tracking range is shifted in accordance with a discontinuous change of a resonance frequency of the die body during the plastic shaping of the forging material to deviate from the vibration frequency, the vibration applying apparatus changes the reference frequency so as to fall within a shifted tracking range.

[15] In the forging apparatus as recited in any one of the aforementioned Items [10] to [14], it may be configured such that the vibration applying apparatus includes a vibrator attached to the die body and an ultrasonic vibration device.

[16] In the forging apparatus as recited in any one of the aforementioned Items [10] to [15], it may be configured such that the vibration applying apparatus is configured to change the reference frequency after a certain time has elapsed from a start of the plastic shaping of the forging material by the punch during the plastic shaping of the forging material while applying the ultrasonic vibration to the die body.

[17] In the forging apparatus as recited in any one of the aforementioned Items [10] to [16], it may be configured to further include: a timer configured to measure an elapsed time from a start of the plastic shaping of the forging material by the punch during the plastic shaping of the forging material; and a reference frequency changing device configured to change the reference frequency based on the elapsed time.

[18] In the forging apparatus as recited in any one of the aforementioned Items [10] to [17], it may be configured to further include: a load detector configured to detect a load of the punch applied to the forging material; and a reference frequency changing device configured to change the reference frequency at a time when the load of the punch has reached a reference frequency changing load value set in advance based on information from the load detector during the plastic shaping of the forging material while applying the ultrasonic vibration to the die body.

According to the forging method of some embodiments of the present invention as recited in the aforementioned Item [1] or [2], since the reference frequency as an initial value of vibration frequency is changed so as to fall within a tracking range corresponding to the changed resonance frequency when the resonance frequency changes in a discontinuous manner, the vibration frequency can be assuredly converged to the resonance frequency, which enables assured vibration of the die body in a resonant condition. Accordingly, the effects by vibration application such as, e.g., decrease of shaping load and improvement of the shape transfer property, can be obtained assuredly.

According to the forging method of some embodiments of the present invention as recited in the aforementioned Item [3] or [4], it is possible to more assuredly vibrate the die body in a resonant condition.

According to the forging method of some embodiments of the present invention as recited in the aforementioned Item [5], the time of changing the reference frequency can be obtained easily.

According to the forging method of some embodiments of the present invention as recited in the aforementioned Item [6], the time of changing the reference frequency can be obtained accurately.

According to the forging method of some embodiments of the present invention as recited in the aforementioned Item [7], the time of changing the reference frequency can be obtained more easily.

According to the forging method of some embodiments of the present invention as recited in the aforementioned Item [8], the time of changing the reference frequency can be obtained more accurately.

According to the forging method of some embodiments of the present invention as recited in the aforementioned Item [9], it is possible to prevent the vibration manner from becoming unstable immediately before changing the reference frequency, which can effectively prevent occurrence of, e.g., overload error.

According to the forging apparatus as recited in any one of the aforementioned Items [10] to [18], it is possible to provide a forging apparatus capable of assuredly performing forging.

BRIEF DESCRIPTION OF THE DRAWINGS

Some embodiments of the present invention are shown by way of example, and not limitation, in the accompanying figures.

EMBODIMENTS FOR CARRYING OUT THE INVENTION

Figure 1:
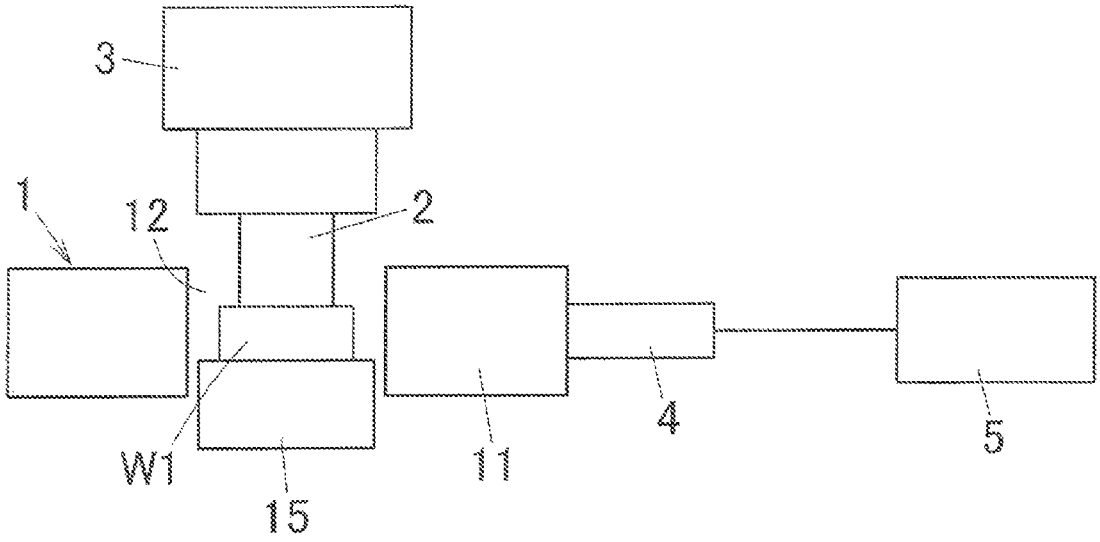
FIG. 1 is a block diagram showing a forging apparatus capable of executing a forging method according to a first embodiment of the present invention.

In the following paragraphs, some embodiments in this disclosure will be described by way of example and not limitation. It should be understood based on this disclosure that various other modifications can be made by those in the art based on these illustrated embodiments. In the drawings, the size and position of each member may be exaggerated or simplified for clarity.

(1) First Embodiment

FIG. 1 is a schematic block diagram showing a forging apparatus capable of executing a forging method according to a first embodiment of the present invention. As shown in FIG. 1, this forging apparatus is provided with, as fundamental structural elements, a die 1 as a lower die, a punch 2 as an upper die, a raising-and-lowering driving mechanism 3 for raising and lowering the punch 2, a vibrator 4 for generating ultrasonic vibration, and an ultrasonic vibration device 5 for driving the vibrator 4.

The die 1 is provided with a cylindrically-shaped or doughnut-shaped die body 11 having a columnar shaping hole 12 at its center, and a shaping pin 15 arranged at a lower end portion in the shaping hole 12 of the die body 11. The inner peripheral surface of the shaping hole 12 shapes an outer peripheral surface of a forged article W2, and the upper end surface of the shaping pin 15 shapes a lower surface of the forged article W2.

The shaping pin 15 may be configured to be movable in the up-down direction to concurrently use as a knock-out pin for pushing out the forged article W2 from the shaping hole 12 after forging. Alternatively, instead of concurrently using the shaping pin 15 as a knock-out pin, a separate knock-out mechanism may be provided.

Figure 2A:
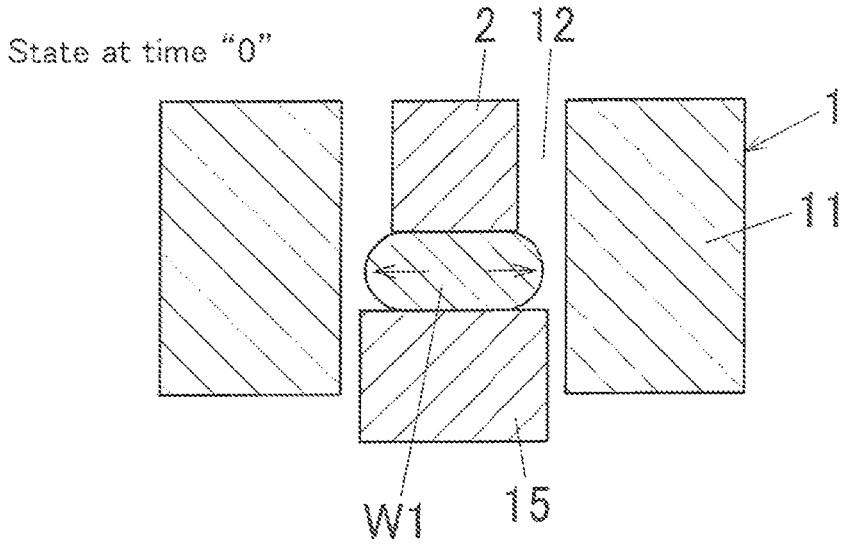
FIG. 2A is a block diagram showing a state immediately after introducing a forging material in a forging apparatus according to the first embodiment.

The punch 2 is coaxially arranged in the shaping hole 12, and is movable up and down by the raising-and-lowering driving mechanism 3. As shown in FIG. 2A, in a state in which a forging material W1 is placed in the shaping hole 12 of the die body 11, the punch 2 is driven into the shaping hole 12 by lowering the punch 2. This applies a predetermined shaping load to the forging material W1, so that a cup-shaped forged article W2 corresponding to the inner shape of the die 1 as shown in FIG. 2F is formed.

In this embodiment, using a disk-shaped material as a forging material W1, a cup-shaped forged article W2 is obtained. Needless to say, however, in the present invention, the shape of the forging material W1 is not limited to a disk-shape, but may be of any shape, such as, e.g., a polygonal columnar shape, a spherical shape, and a polygonal shape. Further, the forged article W2 is not limited to a cup-shaped article, but may be of any shape.

As shown in FIG. 1, a vibrator 4 is coupled or attached to an outer peripheral surface of the die body 11. The vibrator 4 is configured to generate ultrasonic vibration depending on the output value of the ultrasonic vibration device 5. The ultrasonic vibration wave generated by the vibrator 4 is transmitted to the die body 11 via the contact surface contacting the die body 11.

In the present invention, it may be configured such that a horn is provided between the vibrator 4 and the die body 11 to transmit the ultrasonic vibration generated by the vibrator 4 to the die body 11 via the horn.

In this embodiment, the vibrator 4 and the ultrasonic vibration device 5 constitute a vibration applying apparatus. In cases where a horn is provided, the horn, the vibrator 4, and the ultrasonic vibration device 5 constitute a vibration applying apparatus.

In this embodiment, as a material of the forging material W1, a material produced by a method of, e.g., cutting an aluminum (including its aluminum alloy) continuously cast material into a predetermined length, a material produced by a method of, e.g., compressively shaping aluminum powder into a billet shape, then shaping it into a round bar-shape by hot extrusion, and cutting the extruded material into a predetermined length, a drawn material, or a pressed material, etc., may also be used.

In this embodiment, the ultrasonic vibration device 5 is configured such that at the time of vibrating the vibrator 4, the reference frequency as an initial value of a vibration frequency can be changed arbitrarily and that the reference frequency can be changed arbitrarily during the shaping operation. Further, the ultrasonic vibration device 5 of this embodiment is provided with a tracking function as will be detailed later, and when the vibrator 4 is driven in a state in which the reference frequency is set near the resonance frequency of the die body 11, the vibration frequency of the vibrator 4 is converged from the initial reference frequency to the resonance frequency, and becomes equal to the resonance frequency.

<Explanation of Change of Resonance Frequency>

In the forging apparatus of this embodiment, as will be described below, during the process of plastic shaping of the forging material W1, the resonance frequency of the die body 11 changes.

That is, FIG. 3 is a graph showing a relation between a resonance frequency of the die body 11 and a shaping process time according to the ultrasonic forging of this embodiment. The vertical axis indicates a resonance frequency, and the horizontal axis indicates a shaping process time.

In this graph, the time "0" of the shaping process time corresponds to the time when the forging material W1 is loaded in the shaping hole 12 of the die 1. In this state, as shown in FIG. 2A, the forging material W1 and the shaping hole inner peripheral surface are substantially not in contact with each other, and there exists a certain clearance between them.

Figure 2B:
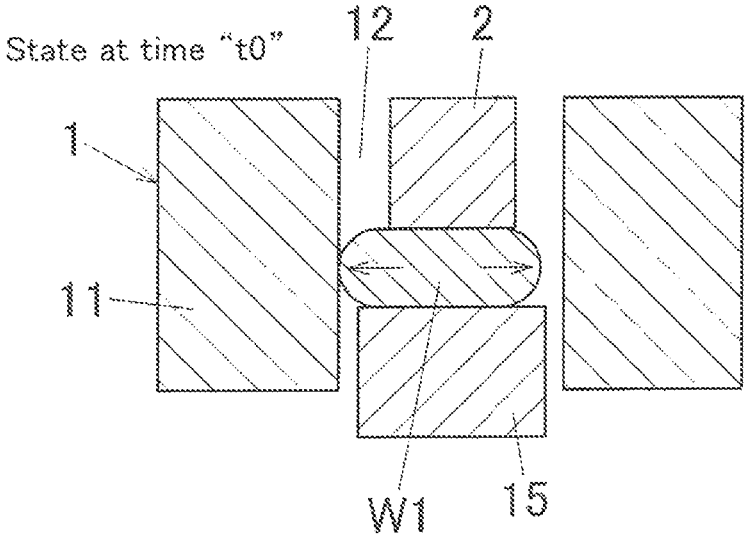
FIG. 2B is a block diagram showing a state immediately after start of shaping in the forging apparatus according to the first embodiment.

The time "t0" corresponds to, as shown in FIG. 2B, the time when the forging material W1 is pressed with the descending punch 2 and the forging material W1 starts contacting with the shaping hole inner peripheral surface. This time "t0" corresponds to the time when shaping of the forging material W1 by the punch 2 starts.

In the forging, after the time "t0," contact points of the forging material W1 to the shaping hole inner peripheral surface start to appear, and thereafter as the shaping process progresses, contact points are generated probabilistic phenomenally, and increase.

Figure 2C:
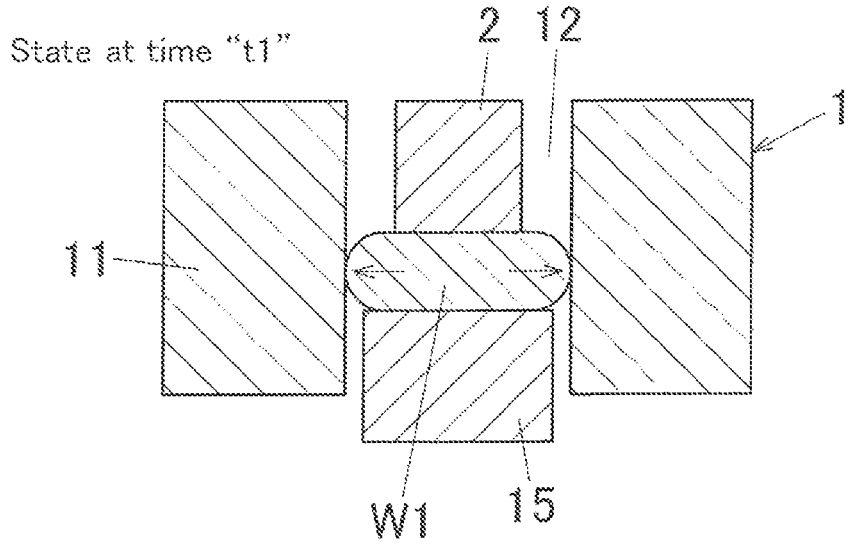
FIG. 2C is a block diagram showing a state immediately after shifting of a contact state to a sufficient contact state in which the forging material is in sufficient contact with an inner peripheral surface of the shaping hole in the forging apparatus according to the first embodiment.

The time "t1" corresponds to, as shown in FIG. 2C, the time when the forging material W1 is sufficiently and plastically deformed outward (in the radially outward direction) and the forging material W1 starts sufficiently contacting with the shaping hole inner peripheral surface. Thus, between the time "t0" and immediately before the time "t1," a state in which the forging material W1 is not sufficiently in contact with the shaping hole inner peripheral surface, i.e., an insufficient contact state, is maintained, and shifted to a sufficient contact state at the time "t1." Here, at the time "t0," the resonance frequency of the die body 11 is "fr0." On the other hand, at the time "t1", the resonance frequency increases instantaneously to "fr1" discontinuously (significantly).

Between the time "t1" and the time "t2", the contact state of the forging material W1 with respect to the shaping hole inner peripheral surface shifts from a sufficient contact state to a substantially perfectly contact state (complete contact state).

Figure 2D:
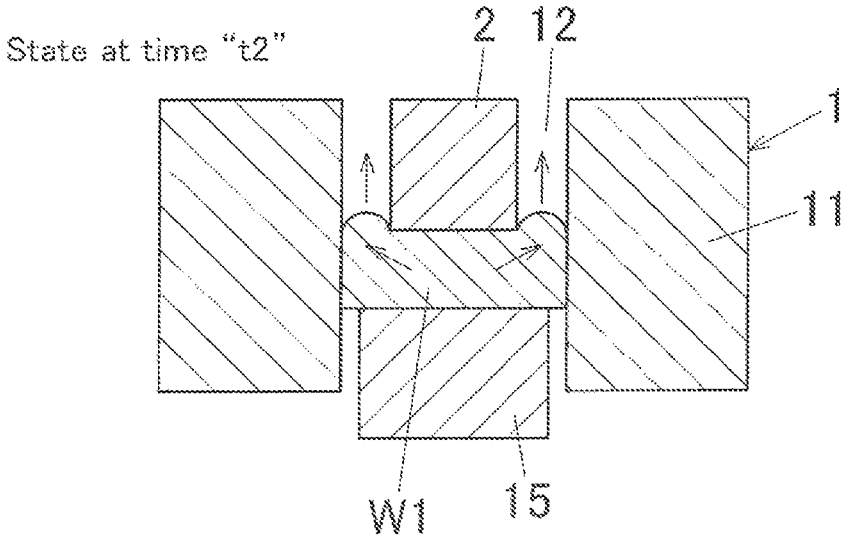
FIG. 2D is a block diagram showing a state immediately after start of filling of the forging material into a punch outer peripheral gap in the forging apparatus according to the first embodiment.

The latter time "t2" corresponds to, as shown in FIG. 2D, the time when filling of the forging material W1 in a gap between the punch 2 and the shaping hole 12 (punch outer peripheral gap) starts, i.e., the time when the rearward extrusion starts. Here, from the time "t1" to the time "t2", the resonance frequency gradually increases from "fr1" to "fr2" in a continuous manner.

Figure 2E:
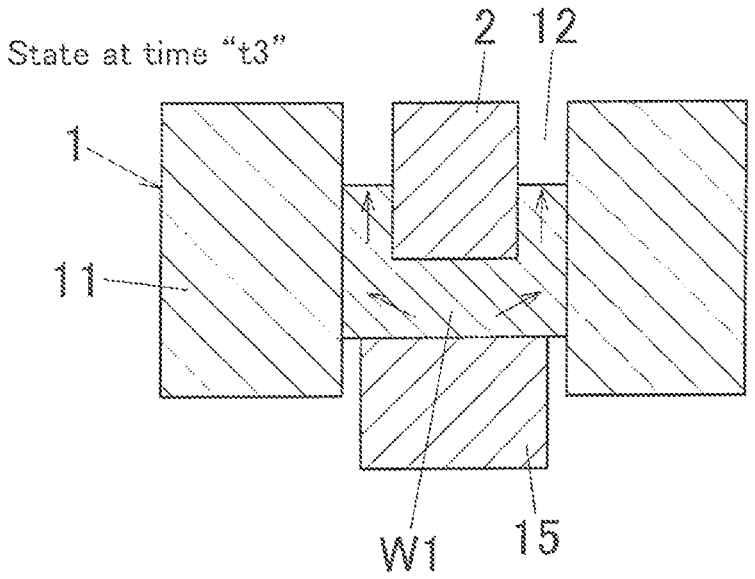
FIG. 2E is a block diagram showing a state immediately after start of filling of the forging material into the punch outer peripheral gap in the forging apparatus according to the first embodiment.
Figure 2F:
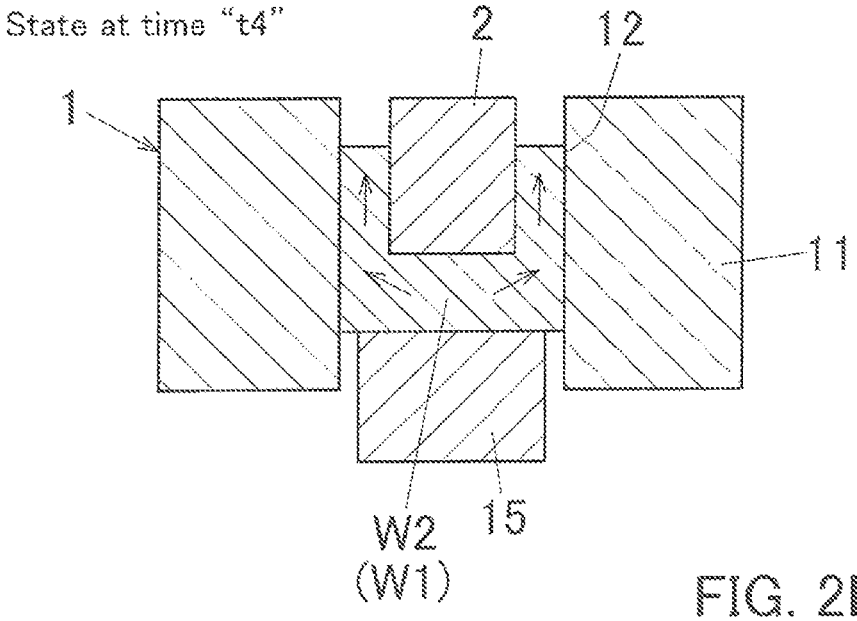
FIG. 2F is a block diagram showing a state immediately after completion of plastic shaping of the forging material in the forging apparatus according to the first embodiment.

The time "t3" corresponds to, as shown in FIG. 2E, the time when the forging material W1 is in the middle of being filled in the punch outer peripheral gap by the rearward extrusion and the forging material W1 starts sufficiently contacting with the shaping hole inner peripheral surface. Thus, between the time "t2" and immediately before the time "t3", a complete contact state in which the forging material W1 is in complete contact with the shaping hole inner peripheral surface (die inner peripheral side surface) is maintained, and at the time "t3", it becomes a state in which the forging material W1 is in sufficient contact with the punch outer peripheral side surface. Here, at the time "t2," the resonance frequency of the die body 11 is "fr2." On the other hand, at the time "t3", the resonance frequency increases instantaneously to "fr3" discontinuously (significantly).

The time "t4" corresponds to, as shown in FIG. 2F, the time when the forging material W1 is completely filled in the punch outer peripheral gap and the shaping is completed. Thus, between the time "t3" and immediately before the time "t4," a state in which the forging material W1 is sufficiently in contact with the punch outer peripheral side surface is maintained. Here, between the time "t3" and the time "t4", the resonance frequency gradually increases from "fr3" to "fr4" continuously.

In this embodiment, in a contact state in which the forging material W1 is in contact with the shaping hole inner peripheral surface, an "insufficient contact state" means a state in which contact points of the forging material W1 to the shaping hole inner peripheral surface are eccentrically arranged to a part of the shaping hole inner peripheral surface in the peripheral direction. A sufficient contact state means a state in which contact points of the forging material W1 to the shaping hole inner peripheral surface are arranged dispersedly over a long range in the circumferential direction. A "complete contact state" means a state in which the forging material W1 is in contact with the shaping hole inner peripheral surface over the entire area in the circumferential direction of the shaping hole inner peripheral surface.

Further, in a contact state in which the forging material W1 is in contact with the punch outer peripheral side surface, an "insufficient contact state" means a state in which the forging material W1 is not sufficiently filled in the punch outer peripheral gap. A "sufficient contact state" means a state in which the forging material W1 is sufficiently filled in the punch outer peripheral gap.

The insufficient contact state and the sufficient contact state with respect to the shaping hole inner peripheral surface and the punch outer peripheral side surface will be explained.

<Explanation of Tracking Range>

Figure 4A:
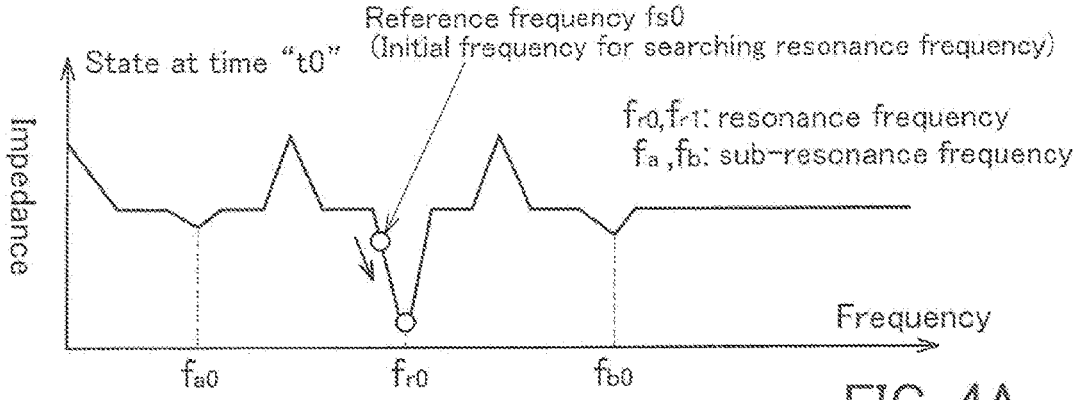
FIG. 4A is a graph showing an impedance curve line immediately after shaping in the forging apparatus according to the first embodiment.

FIG. 4A is a graph showing an impedance curve line at the time "t0" in this embodiment, and the vertical axis indicates an impedance proportional to a vibrator load, and the horizontal axis indicates a frequency.

As shown in this graph, in the state at time "t0" in which the forging material W1 is not sufficiently in contact with the shaping inner peripheral surface, the "fr0" is a resonance frequency of the die body 11, which is a frequency at which the die body 11 vibrates in the radial direction and the impedance of the vibrator 4 is a minimum value as well. This means that a vibration force (vibrator load) required for the vibrator 4 becomes minimum at the time when the vibration frequency becomes equal to the resonance frequency by changing the vibration frequency of the vibrator 4 while controlling so that the amplitude of vibration by the vibrator 4 is maintained constant. This state can be said as the most efficiently vibrating state. Further, there exist sub-resonance frequencies "fa0" and "fb0" around the resonance frequency "fr0", and these sub-resonance frequencies "fa0" and "fb0" each are a valley bottom of the impedance curve line in the same manner as the resonance frequency "fr0". However, the vibration manner at the sub-resonance frequencies "fa0" and "fb0" are different from the vibration manner at the resonance frequency "fr0", and includes, for example, torsional vibration and bending vibration, and the amplitudes at the shaping hole inner peripheral surface are unequal. Further, at the sub-resonance frequencies "fa0" and "fb0", as compared with the case at the resonance frequency "fr0", the impedance is higher, and the load of the vibrator 4 increases, which makes it difficult to effectively vibrate the die body 11.

Figure 5:
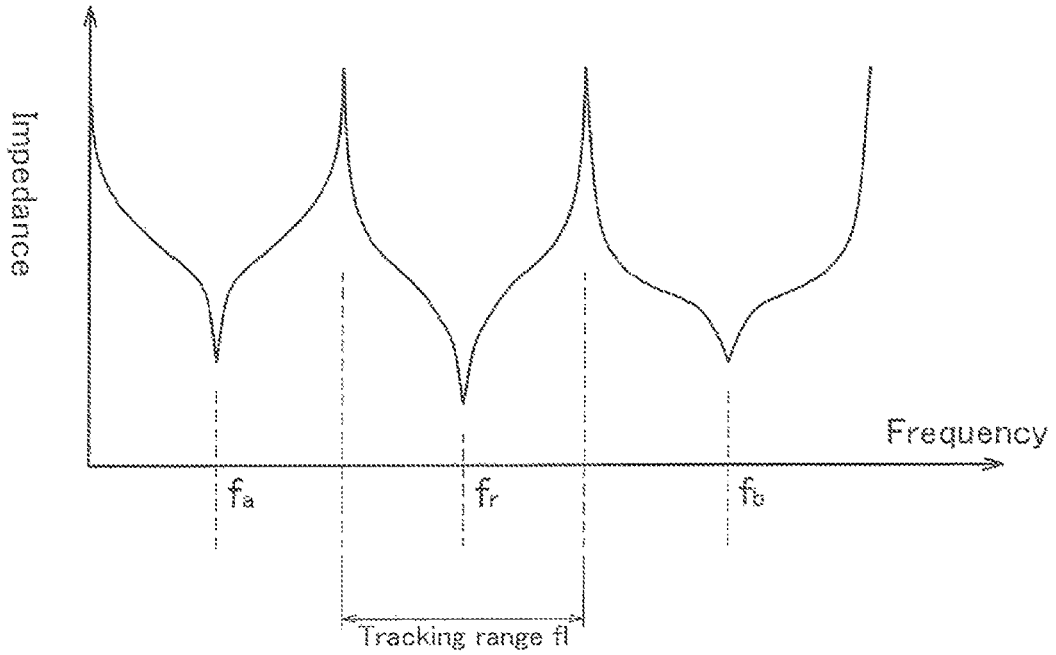
FIG. 5 is a graph showing an impedance curve line for explaining a tracking range of a resonance frequency.

On the other hand, as a tracking method which is generally used in the ultrasonic vibration device 5, a PLL (Phase Locked Loop) method is known. In this method, the vibration frequency of the ultrasonic vibration device 5 is tracked so as to conform to the resonance frequency by converging the driving frequency (vibration frequency) of the vibrator 4 by the ultrasonic vibration device 5 to the valley bottom of the impedance curve line. For example, as shown in FIG. 5, when the vibration frequency of the ultrasonic vibration device 5 is within a range of the tracking range fl of the resonance frequency, the vibration frequency converges to the resonance frequency fr, and when not within the tracking range fl, the vibration frequency converges to the sub-resonance frequency fa or fb in another frequency range. Therefore, the tracking range means a range in which the vibration frequency of the ultrasonic vibration device 5 can be converged to a resonance frequency, and is a specific range including a resonance frequency "fr0".

In an ultrasonic shaping using a normal PLL method, it is configured such that the reference frequency as an initial vibration frequency of the ultrasonic vibration device 5 is set to "fs0" as shown by "○" in FIG. 4A in the tracking range, and driving of the vibrator 4 is initiated at this frequency "fs0" and the vibration frequency is made to be converged to the resonance frequency "fr0" to thereby vibrate the die body 11 at the resonant condition.

In the PLL method, the impedance is not directly measured, and as disclosed in the aforementioned Patent Document 2, etc., it is common that the vibration frequency is made to be converged to the valley bottom of the impedance curve line by converging the phase difference between the current and the voltage of the vibrator to zero.

The resonance frequency "fr" changes during the forging process as explained above with reference to FIG. 3A. In accordance with the change, the tracking range "fl" also changes. For example, as shown in FIG. 3B, a predetermined frequency range including a resonance frequency "fr" becomes a tracking range "fl", and the tracking range "fl" continuously rises so as to follow the continuous rise of the resonance frequency "fr".

Figure 3A:
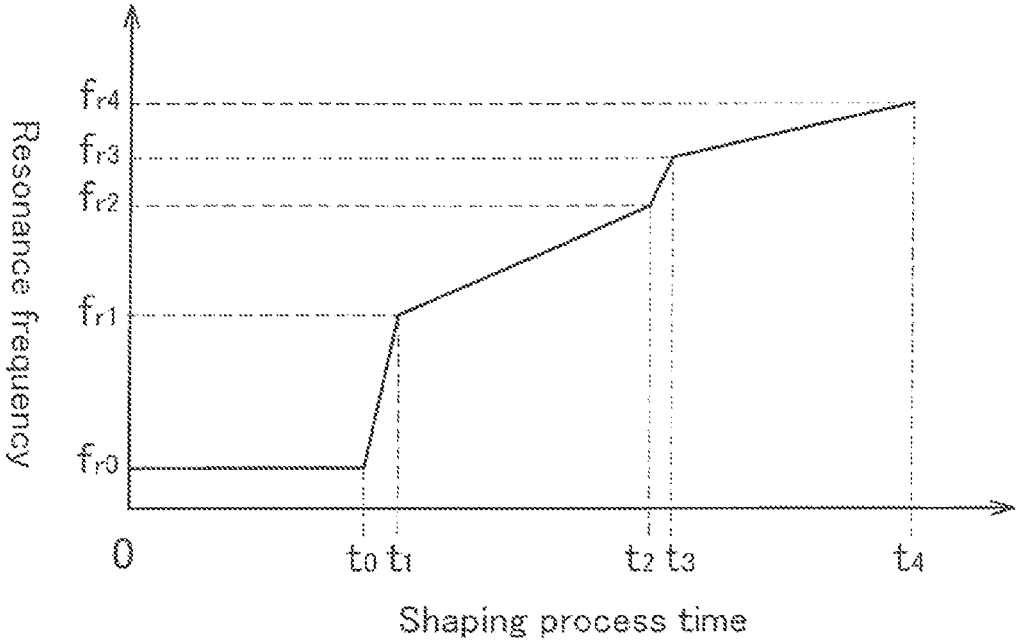
FIG. 3A is a block diagram showing a relation between a resonance frequency and a shaping process time in the forging apparatus according to the first embodiment.
Figure 3B:
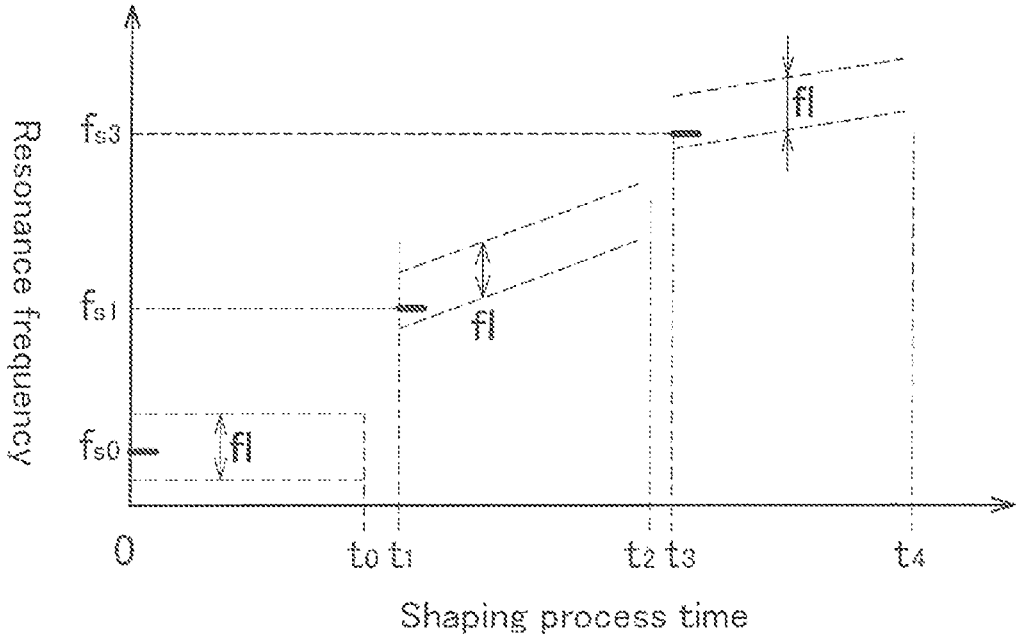
FIG. 3B is a block diagram showing a relation between a reference frequency and a shaping process time in the forging apparatus according to the first embodiment.

Here, as shown in FIGS. 3A and 3B, the resonance frequency "fr" increases instantaneously in a discontinuous manner when shifting from the time "t0" to the time "t1", and in accordance with the instantaneous increase, the tracking range "fl" is also changed instantaneously in a discontinuous manner. For example, at the time "t0", the impedance curve line is in a state shown in FIG. 4A. On the other hand, at the time "t1", the impedance curve line changes instantaneously to the state shown in FIG. 4B. For this reason, even if the vibration frequency of the ultrasonic vibration device 5 matches the resonance frequency "fr0" immediately before the time "t1", the resonance frequency changes instantaneously to "fr1" at the time of "t1", and in accordance with that, the tracking range fl also shifts instantaneously. As a result, as shown by "○" in FIG. 4B, the vibration frequency of the ultrasonic vibration device 5 moves away from the shifted tracking range. As a result, the vibration frequency of the vibrator 4 does not converge to the shifted resonance frequency "fr1", but converges to, for example, the shifted sub-resonance frequency "fa1". For the reasons described above, the die body 11 cannot be vibrated in a resonant condition, and therefore desired effects cannot be obtained.

Figure 4B:
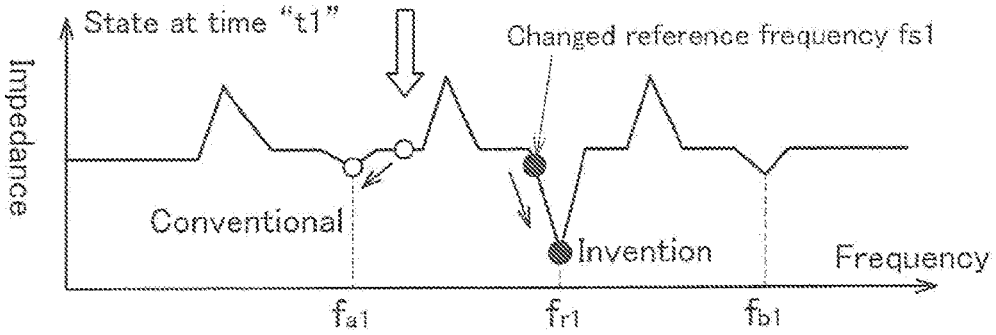
FIG. 4B is a graph showing an impedance curve line immediately after shifting of a contact state to a sufficient contact state in which the forging material is in sufficient contact with a shaping hole inner peripheral surface.

Under the circumstance, in this embodiment, when the resonance frequency shifts in a discontinuous manner, specifically when the time shifts from the time "t0" to the time "t1", as shown by "●" in FIG. 4B, the resonance frequency is shifted to "fs1" within the tracking range of the shifted resonance frequency "fr1". With this, the vibration frequency of the ultrasonic vibration device 5 converges to the resonance frequency "fr1", which enables effective vibration of the die body 11 in a resonant condition. Thus, desired effects can be obtained.

In the same manner, when the time has reached from the time "t2" to the time "t3" and the resonance frequency discontinuously shifts to "fr3", as shown in FIGS. 3A and 3B, the reference frequency is changed to "fs3" which is within the tracking range "fl" of the shifted resonance frequency "fr3". With this, the vibration frequency of the vibrator 4 converges to the resonance frequency "fr3", which enables effective vibration of the die body 11 in a resonant condition. Thus, desired effects can be obtained.

Figure 6:
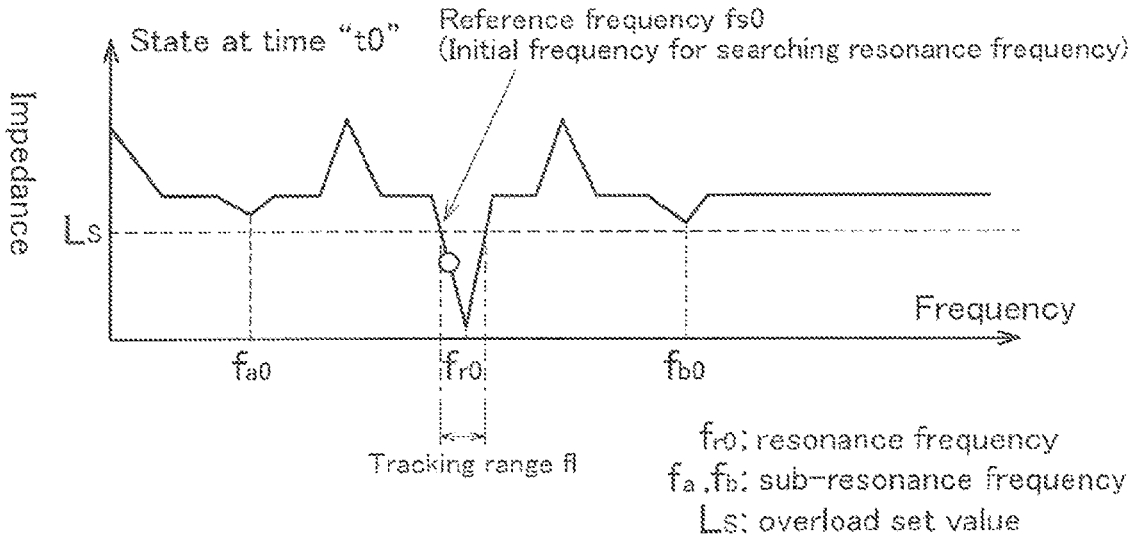
FIG. 6 is a graph showing an impedance curve line to which an overload set value is added immediately after start of shaping in a forging apparatus according to the first embodiment.

In an ultrasonic forging, normally, an overload set value is set to avoid excessive current flow in the ultrasonic vibration device 5, and the substantial tracking range changes also by the overload set value. That is, when a voltage equal to or higher than a predetermined value is applied to the ultrasonic vibration device 5, the ultrasonic vibration device 5 is deactivated to stop generation of vibration, generating an overload error. At that time, when current is made constant to attain a constant amplitude, a voltage rises as the impedance increases, and therefore the impedance exceeding a predetermined value causes an overload error, resulting in stopping of vibration. For example, as shown in FIG. 6, in a case in which the impedance exceeds the overload set value "Ls" at a location other than the vicinity of the resonance frequency "fr0", the tracking range "fl" is essentially limited to a narrow range equal to or below the overload set value "Ls", and therefore it is required to set the reference frequency "fs0" within this narrow range.

Further, in cases where an overload error occurs at a location other than the vicinity of the resonance frequency by the overload set value "Ls", in order to prevent occurrence of an overload error when changing the reference frequency to "fs1" after the time "t0" to "t1" at which the resonance frequency changes in a discontinuous manner, it is preferable that vibration be stopped immediately before reaching the time "t0" and the reference frequency is changed to "fs1" approximated to the resonance frequency "fr1" after reaching the time "t1", and then vibration is restarted.

In the same manner, in order to prevent occurrence of an overload error when changing the reference frequency to "fs3" at the time of "t2" to "t3", it is preferable that vibration be stopped immediately before reaching the time "t2" and the reference frequency is changed to "fs3" approximated to the resonance frequency "fr3" after reaching the time "t3", and then vibration is restarted.

<Explanation of Contact State of Forging Material to Shaping Hole Inner Peripheral Surface>

Next, in this embodiment, a contact state of the forging material W1 with respect to the shaping hole inner peripheral surface will be explained in detail with specific examples.

FIGS. 7A to 7E each are a plan view for explaining a contact state of the forging material W1 with respect to a shaping hole inner peripheral surface (inner peripheral side surface) of a die. As shown in these figures, in a plan view state or a horizontal cross-sectional view, the contact point of the forging material W1 with respect to the shaping hole inner peripheral surface of the die 1 is defined as "A". In a case in which there are two or more (plural) contact points A, an angle between the line segment AO connecting one of contact points between adjacent two contact points A and the center O of the shaping hole 12 and the line segment AO connecting the other contact point A and the center O of the shaping hole 12 is defined as "θ". When the maximum value θmax among the center angles θ of the adjacent contact points exceeds 180 degrees (θmax>180 degrees), the contact state is defined as an "insufficient contact state". When the maximum value θmax is equal to or less than 180 degrees (θmax≤180 degrees), the contact state is defined as an "sufficient contact state".

Figure 7A:
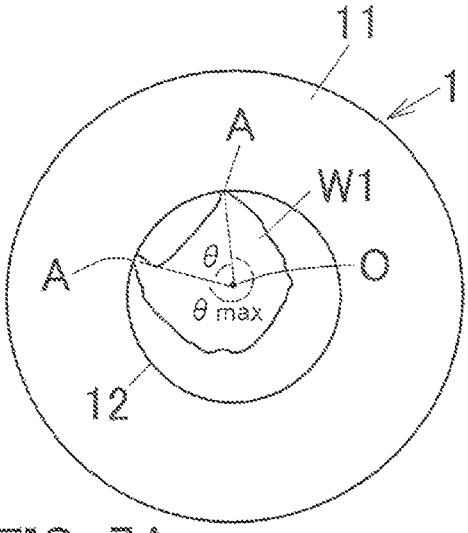
FIGS. 7A to 7E each are a plan view for explaining a contact state of the forging material with respect to a die shaping hole inner peripheral surface.
Figure 7B:
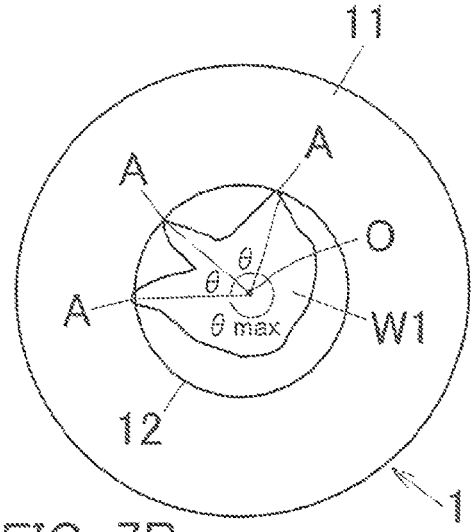
Figure 7C:
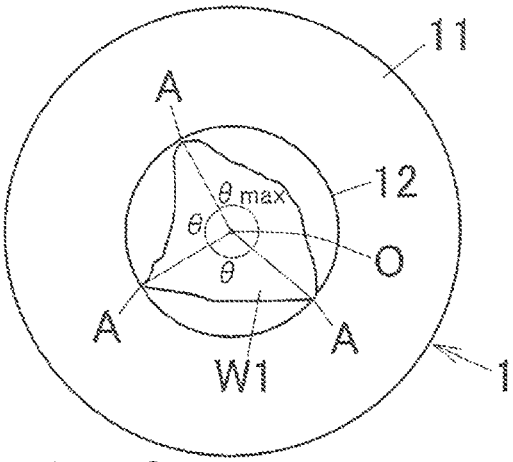
Figure 7D:
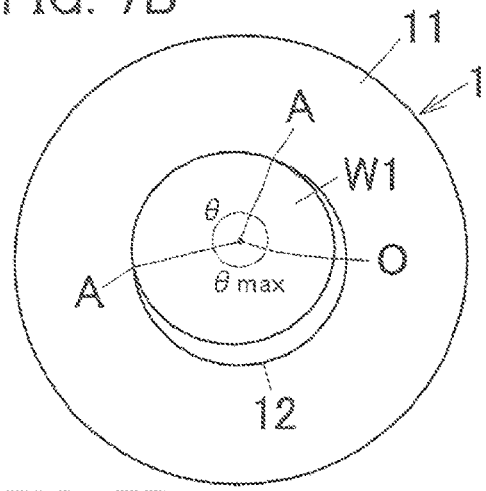
Figure 7E:
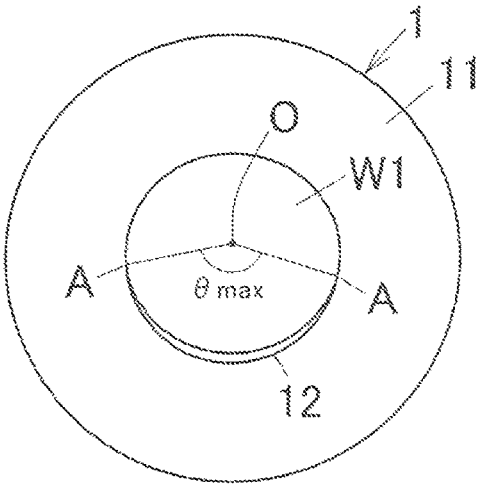

For example, in the case of FIGS. 7A and 7B, since θmax exceeds 180 degrees, the contact state is defined as an insufficient contact state. Further, in the case of FIG. 7C, since θmax is equal to or less than 180 degrees, the contact state is defined as a sufficient contact state.

Further, even in cases where the forging material W1 is in line contact with the shaping hole inner peripheral surface in a plan view (horizontal cross-sectional view) state, contact states can be classified based on the center angle maximum value θmax. For example, in the case of FIG. 7D, since θmax exceeds 180 degrees, the contact state is defined as an insufficient contact state. Further, in the case of FIG. 7E, since θmax is less than 180 degrees, the contact state is defined as a sufficient contact state.

For reference, in cases where the number of contact points A is 2 and the center angle is 180 degrees, the contact state is defined as a sufficient contact state. Further, in cases where the number of contact points A is 1, the contact state is defined as an insufficient contact state.

In this embodiment, the center of the shaping hole 12 is a least-square circle applied to the shaping hole contour line (inner peripheral surface). This least-square circle is obtained by a least-square method.

Here, in this embodiment, the distance along the shaping hole inner peripheral surface between adjacent two contact points (circumferential directional length) is defined as a distance between adjacent contact points. A case in which the maximum value between adjacent contact points exceeds the half of the shaping hole entire peripheral length is defined as a state in which a plurality of contact points A are arranged disproportionately in a range less than half of the shaping hole inner peripheral surface. This state corresponds to the state in which θmax exceeds 180 degrees (the state of [θmax>180 degrees]), and is defined as an insufficient contact state. Further, the case in which the maximum value between adjacent contact points is less than half of the shaping hole entire peripheral length is defined as a state in which a plurality of contact points A are arranged in a range more than half of the shaping hole inner peripheral surface. This state corresponds to the state in which θmax exceeds 180 is equal to or less than 180 degrees (the state of [θmax≤180 degrees]), and is defined as a sufficient contact state.

In this embodiment, the cross-sectional shape (planar shape) of the shaping hole 12 of the die body 11 is formed into a circular shape, but not limited to it. In the present invention, the cross-sectional shape of the shaping hole 12 may be a non-circular shape, such as, e.g., a polygonal shape, an elliptical shape, an oval shape, and an irregular shape. In this case, with reference to the center angle θ between adjacent contact points, the contact states may be classified into an insufficient contact state and a sufficient contact state. Alternatively, with reference to the distance between adjacent contact points (circumferential directional length), the contact states may be classified into an insufficient contact state and a sufficient contact state.

In this embodiment, the state from the time when the forging material W1 starts contacting with the shaping hole inner peripheral surface (shaping start time) until the time when the contact state becomes a sufficient contact state is defined as an insufficient contact state, but not limited to it. In the present invention, the state from the time when the forging material W1 is loaded in the shaping hole 12 until the time when the shaping starts (i.e., non-contact state) may be included in an insufficient contact state. In other words, a case in which the forging material W1 has no contact point to the shaping inner peripheral surface (i.e., a case in which the number of contact points is 0), the state of the case may be defined as an insufficient contact state.

<Explanation of Resonance Frequency Changes Due to Changes of Vibration Manner>

In this embodiment, when the contact state of the forging material W1 to the shaping hole inner peripheral surface shifts from an insufficient contact state to a sufficient contact state, the resonance frequency changes in a discontinuous manner. However, the detail analysis revealed that the vibration manner changes instantaneously and immediately before being shifted to the sufficient contact state, and the resonance frequency shifts in a discontinuous manner at the time of shifting.

Figure 8A:
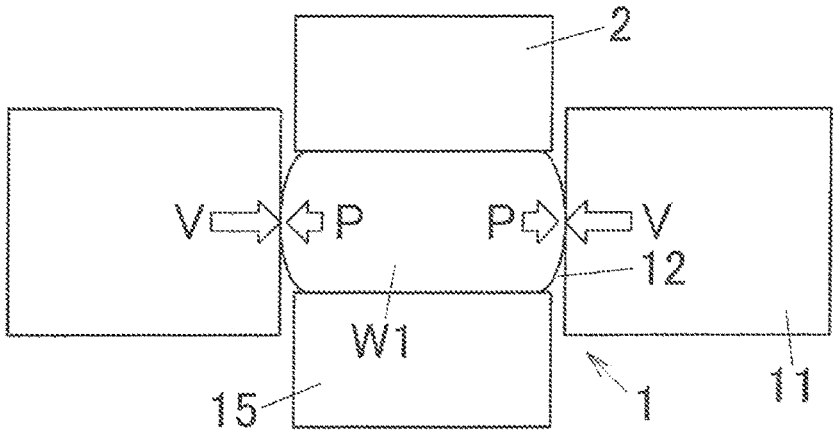
FIG. 8A is a block diagram for explaining a relation between a surface pressure and a vibration stress in a forging die.
Figure 8B:
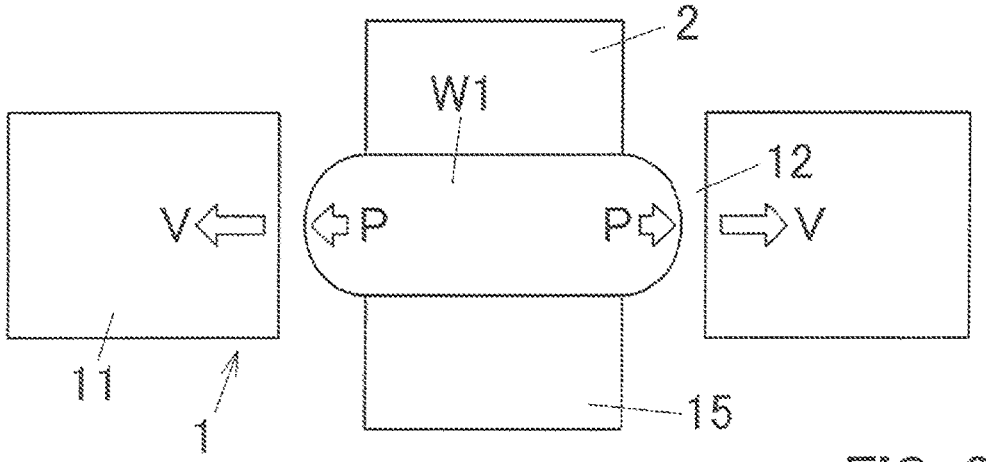
FIG. 8B is a block diagram for explaining a relation between a surface pressure and a vibration stress in the forging die.
Figure 8C:
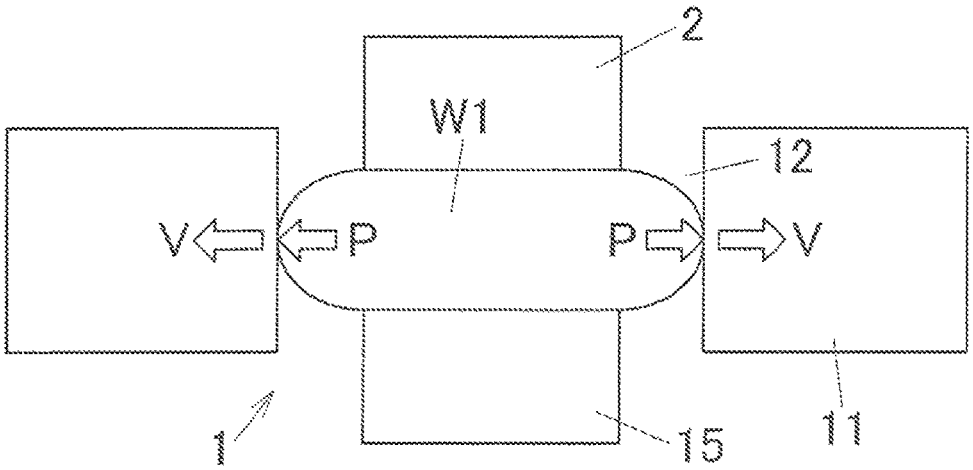
FIG. 8C is a block diagram for explaining a relation between a surface pressure and a vibration stress in the forging die.

That is, as shown in FIGS. 8A to 8C, the vibration manner changes instantaneously at the time when the relation between the surface pressure P of the forging material W1 and the vibration stress V by ultrasonic vibration reverses during the forging in this embodiment, and in accordance with it, the resonance frequency also changes instantaneously.

The vibration stress V means a vibration stress on the shaping hole inner peripheral surface of the die body 11 vibrated by vibration given by the vibrator 4. This vibration stress V is a stress generated when the die body 11 is expanded and contracted by vibration, and corresponds to a vibration stress generated in a radial direction at the interface between the shaping hole inner peripheral surface and the forging material W1. This vibration stress V is caused by vibration of the vibrator 4, and therefore regardless of the process time, the vibration stress V is basically maintained constant.

Under the circumstance, when the surface pressure P of the forging material W1 is lower than the vibration stress V, as shown in FIG. 8A, at the moment when the die body 11 is being contracted by vibration, the shaping hole inner peripheral surface and the forging material W1 are in contact with each other, and as shown in FIG. 8B, at the moment when the die body 11 is being expanded by vibration, the shaping hole inner peripheral surface and the forging material W1 are separated. In other words, when the surface pressure P is lower than the vibration stress V, the contact and the separation are repeated. In cases where the contact and the separation are repeated, the vibration state of the die body 11 is not affected by the vibration from the forging material W1.

On the other hand, when the surface pressure P of the forging material W1 is larger than the vibration stress V, even at the moment when the die body 1 is contracted as shown in FIG. 8A, or even at the moment when the die body 1 is expanded as shown in FIG. 8C, the close contact state of the shaping hole inner peripheral surface and the forging material W1 is always maintained. That is, at the contact portion of the shaping hole inner peripheral surface and the forging material W1, the forging material W1 is not separated from the shaping hole inner hole peripheral surface and integral therewith in a sense. For this reason, at the contact portion, the vibration of the die body 11 is transmitted to the forging material W1, and the vibration of the forging material W1 is transmitted to the die body 11. In this state, the stiffness of the vibration system increases, and the frequency increases suddenly. At the time when the surface pressure P becomes larger than the vibration stress V, the frequency changes instantaneously, but when the contact state has not been shifted to a sufficient contact state (when the contact portion is arranged disproportionally), the vibration manner is unstable. When ultrasonic vibration is applied to the die body 11 from the vibrator 4 in a state in which the vibration manner is unstable, an overload occurs in the ultrasonic vibration device 5. Therefore, in this embodiment, when the contact state to the shaping hole inner peripheral surface is insufficient, it is preferable that application of ultrasonic vibration be suspended and initiated after being shifted to sufficient contact state.

<Explanation of Contact State of Forging Material to Punch Outer Peripheral Side Surface>

In the shaping process of this embodiment, the forging material W1 is expanded in the radial direction as shown in FIGS. 2A to 2C, and thereafter extruded rearward to be filled in the punch outer peripheral gap as shown in FIGS. 2D to 2F. The case in which the maximum surface pressure generated at the punch outer peripheral side surface at the time when the rearward extrusion is initiated (corresponding to FIG. 2D) is less than the vibration stress is regarded as a contact state in which the contact state of the forging material to the punch outer peripheral side surface is insufficient. The case in which the maximum surface pressure generated at the punch outer peripheral side surface is larger than the vibration stress (corresponding to FIG. 2E, etc.) is regarded as a sufficient contact state.

<Structure and Effects>

As explained above, in the ultrasonic forging, the vibration manner changes from the time "t0" immediately before changing of the contact state of the forging material W1 with respect to the shaping hole inner peripheral surface from an insufficient contact state to a sufficient contact state to the time "t1" when the contact state has changed to the sufficient contact state. At this time, the resonance frequency of the die body 11 suddenly changes, and in accordance with the sudden change, the tracking range also changes suddenly. For this reason, the vibration frequency of the ultrasonic vibration device 5 deviates from the shifted tracking range, which sometime prevents the vibration frequency from being converged to the changed resonance frequency. As a result, it becomes unable to vibrate the die body 11 in a resonant condition, which may cause a difficulty in obtaining sufficient effects by applying vibration.

Under the circumstance, in this embodiment, when the tracking range is shifted due to the change of resonance frequency, the reference frequency is changed within the shifted tracking range. Specifically, immediately after shifting from an insufficient contact state to a sufficient contact state, the reference frequency is changed so as to fall within a tracking range corresponding to a shifted resonance frequency. As a result, the vibration frequency can be assuredly converged to the changed resonance frequency. Accordingly, it becomes possible to vibrate the die body 11 with a sufficient amplitude in a resonant condition, which in turn can attain effects by vibration application, such as, e.g., decrease of shaping load and improvement of shape transfer property.

Further, in this embodiment, the resonance frequency changes in a discontinuous manner and the tracking range also shifts instantaneously when the contact state of the forging material W1 with respect to the punch outer peripheral side surface changes ("t2" to "t3"), and at that time, the vibration frequency is changed so as to fall within a shifted tracking range. With this, in the same manner as explained above, the vibration frequency can be converged to the shifted resonance frequency, which enables effective vibration of the die body 11 in a resonant condition. Specifically, immediately after shifting from an insufficient contact state of the forging immaterial W1 with respect to the punch outer peripheral side surface to a sufficient contact state, the reference frequency is changed so as to fall within the tracking range corresponding to a shifted resonance frequency. Therefore, the vibration frequency can be assuredly converged to the changed resonance frequency.

In this embodiment, the "fr1" and "fr3" as reference frequencies are values obtained based on experimental data or data of previous forging.

Further, in this embodiment, the vibration is once stopped immediately before changing of the tracking range in a discontinuous manner due to the discontinuous change of the resonance frequency, the reference frequency is changed so as to fall within a shifted tracking range after shifting of the tracking range, and then vibration is restarted. For this reason, troubles which occur due to continuous application of vibration, e.g., vibration manner becomes unstable before changing of the reference frequency, changing of the vibration frequency in a region exceeding an overload set value, which in turn causes overload errors, can be effectively prevented.

(2) Second Embodiment

In a forging process of ultrasonic forging, as described above, the contact state of the forging material W1 with respect to the shaping hole inner peripheral surface changes as time passes. Therefore, based on the process elapsed time, the time when the forging material W1 shifts from an insufficient contact state with respect to the shaping hole inner peripheral surface to a sufficient contact state, i.e., the time when the resonance frequency changes in a discontinuous manner, can be predicted. Further, the contact state of the forging material W1 with respect to the punch outer peripheral side surface changes as time passes. Therefore, based on the process elapsed time, the time when the forging material W1 shifts from an insufficient contact state with respect to the punch outer peripheral side surface to a sufficient contact state, i.e., the time when the resonance frequency changes in a discontinuous manner, can be predicted.

In this second embodiment, at the predicted time, the reference frequency (vibration frequency) of the ultrasonic vibration device 5 is changed so as to fall within a tracking range corresponding to the changed resonance frequency to effectively vibrate the die body 11.

Figure 9:
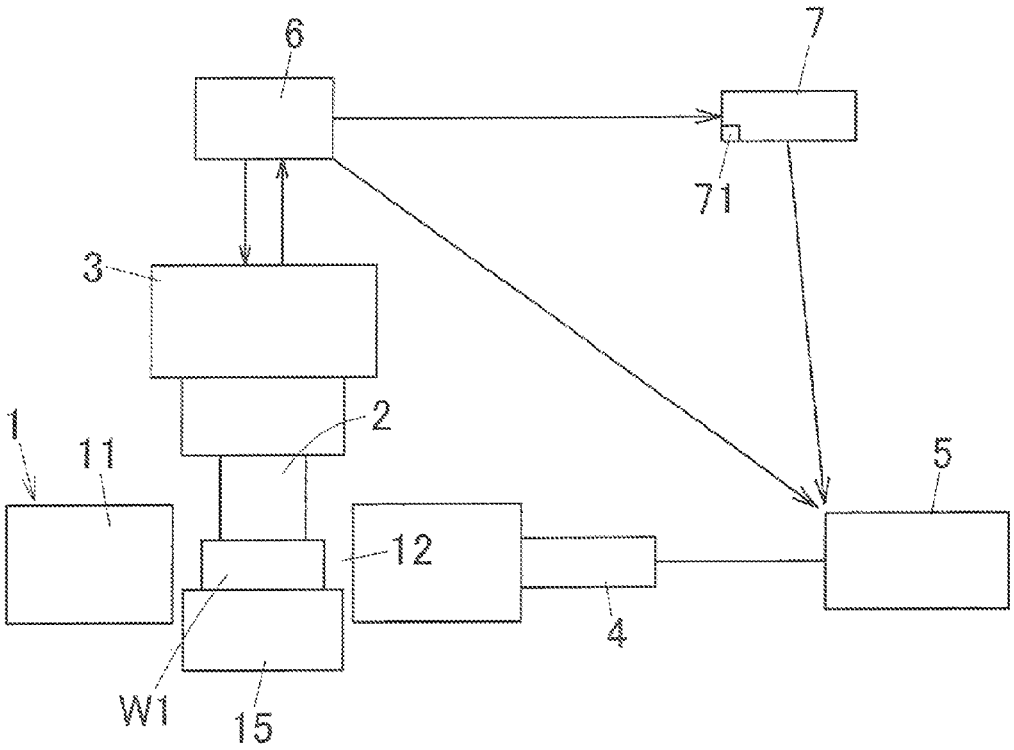
FIG. 9 is a block diagram showing a forging apparatus capable of executing a forging method according to a second embodiment of the present invention.

FIG. 9 is a block diagram showing a forging apparatus (forging die) capable of executing a forging method according to the second embodiment of the present invention. As shown in this figure, this forging apparatus is equipped with a raising-and-lowering control device 6 and a reference frequency changing means 7. In the reference frequency changing means 7, a resonance frequency and a frequency changing time which are obtained by the following method, etc., are set in advance.

The raising-and-lowering control device 6 detects the time when the punch 2 is lowered to press the forging material W1 to initiate shaping of the forging material W1 based on the information from the raising-and-lowering driving mechanism 3. For example, in the case of a mechanical type raising-and-lowering driving mechanism (press) 3, based on the output information from a sensor which detects a rotation angle of a crankshaft of the press 3, the raising-and-lowering control device 6 detects a time when the punch 2 has reached the shaping initiation height as a shaping start time, or based on the output information from a sensor which detects a slide position of the punch 2, the raising-and-lowering control device 6 detects a time when the punch 2 has reached the shaping initiation height as a shaping start time (corresponding to the time "t0" in FIG. 3A). The raising-and-lowering control device 6 that detected the shaping start time "t0" as described above outputs a signal for the shaping start time to the reference frequency changing means 7.

The reference frequency changing means 7 that received the signal, based on the built-in timer 71, measures a time from the shaping start time "t0" (process elapsed time) and transmits a vibration start signal to the ultrasonic vibration device 5. The ultrasonic vibration device 5 that received the vibration start signal drives the vibrator 4 at a vibration frequency as an initial reference frequency (corresponding to "fs0" in FIG. 3B) to start the vibration of the die body 11. Subsequently, the reference frequency changing means 7 transmits a first reference frequency changing signal to the ultrasonic vibration device 5 immediately after the measured time has reached a first frequency changing time (corresponding to the time "t1" in FIG. 3A).

The ultrasonic vibration device 5 that received the first reference frequency changing signal changes the vibration frequency to a first reference frequency (corresponding to "fs1" in FIG. 3B) and drives the vibrator 4 to vibrate the die body 11. Subsequently, the reference frequency changing means 7 transmits a second reference frequency changing signal to the ultrasonic vibration device 5 immediately after the measured time has reached the second frequency changing time (corresponding to the time "t3" in FIG. 3A). The ultrasonic vibration device 5 that received the second reference frequency changing signal changes the vibration frequency to the second reference frequency (corresponding to "fs3" in FIG. 3B) and drives the vibrator 4 to vibrate the die body 11.

On the other hand, when the forging is completed, application of the ultrasonic vibration is stopped. That is, the raising-and-lowering control device 6 detects the time when the shaping is completed (corresponding to the time "t4" in FIG. 3A) based on the information from the raising-and-lowering driving mechanism 3. For example, based on the output information from a sensor that detects a rotational angle of a crankshaft of the press or the output information from a sensor that detects a slide position of the press, the raising-and-lowering control device 6 detects a time when the press has reached the stroke bottom dead point as a shaping completion time. The raising-and-lowering control device 6 that detected the shaping completion time transmits the signal on the shaping completion to the ultrasonic vibration device 5. The ultrasonic vibration device 5 that received the shaping completion signal stops outputting to the vibrator 4. With this, the ultrasonic vibration of the die body 11 by the vibrator 4 is stopped.

Such forging is repeated, so that a forged article is produced sequentially.

In this embodiment, the raising-and-lowering control device 6 and the reference frequency changing means 7 are constituted by, for example, a microcomputer. In this embodiment, the reference frequency changing means 7 functions as a reference frequency changing device.

In this forging apparatus according to the second embodiment, in order to more assuredly prevent occurrence of overload errors, as described above, the vibration may be stopped once immediately before changing to the first reference frequency or immediately before changing to the second reference frequency.

<How to Obtain Resonance Frequency Switching Time>

Next, a method for obtaining the reference frequency changing time will be described specifically.

Figure 10A:
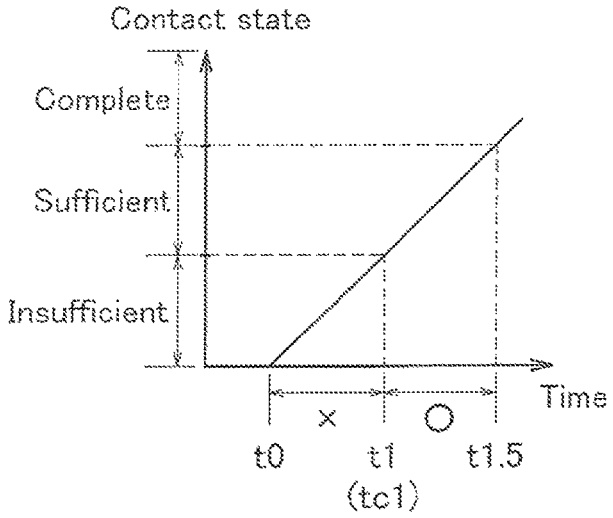
FIG. 10A is a graph showing a relation between a contact state of a forging material with respect to a shaping hole inner peripheral surface and a process elapsed time.
Figure 10B:
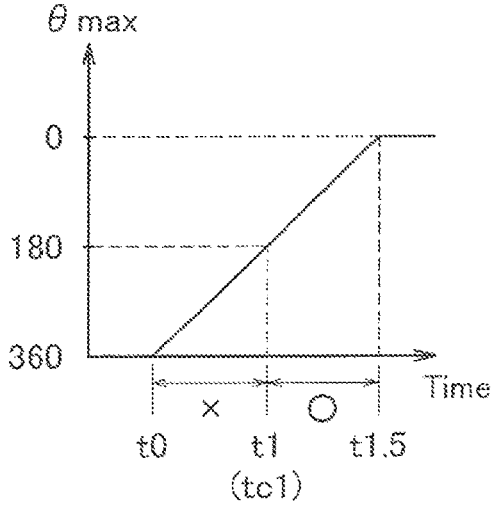
FIG. 10B is a graph showing a relation between a center angle maximum value θmax between contact points and a process elapsed time.
Figure 10C:
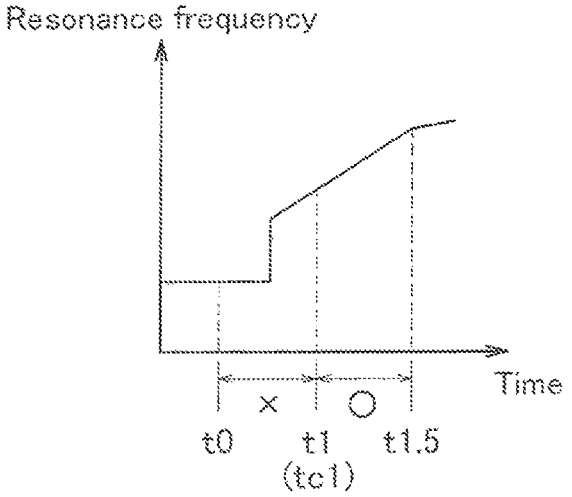
FIG. 10C is a graph showing a relation between a resonance frequency and a process elapsed time.

FIG. 10A is a graph showing a relation between a contact state of the forging material with respect to the shaping hole inner peripheral surface and a process elapsed time. FIG. 10B is a graph showing a relation between a center angle maximum value θmax between the contact points and the process elapsed time. FIG. 10C is a graph showing a relation between a resonance frequency and a process elapsed time.

In these graphs, in the same manner as in the graph of FIGS. 3A and 3B, "t0" denotes a time showing a time when the punch 2 is lowered to start shaping, "t1" denotes a time showing a time when the forging material W1 shifts from the insufficient contact state with respect to the shaping hole inner peripheral surface (θmax>180 degrees) to the sufficient contact state (θmax≤180 degrees), and the time "t1.5" denotes a time showing a time when the forging material W1 shifts from the sufficient contact state to the insufficient contact state (θmax=180 degrees). As will be understood from these graphs, since the resonance frequency changes in a discontinuously immediately before reaching "t1" and the tracking range also shifts instantaneously, when a time reached "t1" with the frequency at the time when a time has not reached "t1" (range shown by "X" in the graph), the vibration frequency of the ultrasonic vibration device 5 deviates from the shifted tracking range, which prevents the vibration frequency from being converged to the resonance frequency. On the other hand, when the reference frequency is changed so as to fall within the shifted tracking range at the time after "t1" (in the range shown by "○" in the graph), the vibration frequency can be converged to the resonance frequency, which enables vibration in the resonant condition.

Considering these circumstances, it is understood that in the forging apparatus shown in FIG. 9, the time corresponding to "t1" is set as a reference frequency changing time "tc1".

Initially, in this embodiment, in the forging apparatus shown in FIG. 9, the reference frequency changing time "tc1" is provisionally set as "t0" to start forging.

In this forging, the time to change the reference frequency is too early, resulting in deviation of the vibration frequency from the tracking range, which prevents the vibration frequency from being converged to the resonance frequency. As a result, the vibration state becomes disordered to cause an overload error, which can be confirmed. Next, the reference frequency changing time "tc1" is set as a time slightly delayed from the aforementioned provisionally set time "t0", and forging is performed in the same manner to confirm that an overload error occurs. By repeating these operations, the reference frequency changing time "tc1" to be provisionally set is gradually and sequentially set to a delayed time, to experimentally find out the earliest time among times at which vibration state is not disturbed and no overload error occurs. The time is considered as a qualified reference frequency changing time "tc1", and the time "tc1" is set to the forging apparatus shown in FIG. 9.

On the other hand, in the same manner as described, based on the time when the contact state of the forging material W1 with respect to the die outer peripheral side surface shifts from an insufficient contact state to a sufficient contact state, a reference frequency changing time "tc3" corresponding to "t3" of FIG. 3A can be decided. That is, any time between "t1" and "t2" shown in FIG. 3A is set as a second reference frequency changing time "tc3", and forging is performed.

In this forging, the time to change the reference frequency is too early, resulting in large deviation of the vibration frequency from the tracking range, which prevents the vibration frequency from being converged to the resonance frequency. Next, a second reference frequency changing time "tc3" is set to a time slightly delayed from the aforementioned provisionally set time, and forging is performed in the same manner to confirm that an overload error occurs. By repeating these operations, the reference frequency changing time "tc3" to be provisionally set is gradually and sequentially set to a delayed time, to experimentally find out the earliest time among times at which vibration state is not disturbed and no overload error occurs. The time is considered as a qualified second reference frequency changing time "tc3", and the time "tc3" is set to the forging apparatus shown in FIG. 9.

By performing forging as described above using the forging apparatus to which the first and second reference frequency changing times "tc1" and "tc2" are set, the forging material can be vibrated assuredly in a resonant condition, which can assuredly attain effects by ultrasonic vibration, such as, e.g., decrease of the shaping load and improvement of the shape transfer property.

In this embodiment, the reference frequency changing time "tc1" and "tc3" is set as the earliest time causing no overload error, but not limited to it. In the present invention, as long as no overload error occurs, any time can be set as the qualified reference frequency changing time "tc1" and "tc3".

According to the forging method of this second embodiment, since the time to change the reference frequency is decided based on the elapsed time, the forging can be performed easily.

In the case of predicting the time (reference frequency changing time) for shifting to a sufficient contact state based on the process elapsed time, the predicted value is stochastic and fractional. In addition, the shaping speed of the forging material W1 changes due to various factors. Accordingly, the predicted value of the time of shifting to a sufficient contact state is preferably set with allowance. For example, a predicted value having a certain allowance (range) is obtained, and considering surrounding environments, shaping conditions, etc., an appropriate time within the range is set as a reference frequency changing time "tc1" and "tc3".

(3) Third Embodiment

Experiments by the present inventors revealed that there is a relation between a load change of the punch and a contact state of the forging material. So, in this third embodiment, a punch load that causes the forging material W1 to shift the contact state with respect to the shaping hole inner peripheral surface and the punch outer peripheral side surface from an insufficient contact state to a sufficient contact state, i.e., a punch load at which the resonance frequency changes in a discontinuous manner, is obtained. And, based on the punch load (reference frequency changing load value), the reference frequency (vibration frequency) of the ultrasonic vibration device is changed so as to fall within a tracking range corresponding to the changed resonance frequency to effectively vibrate the die body 11.

Figure 11:
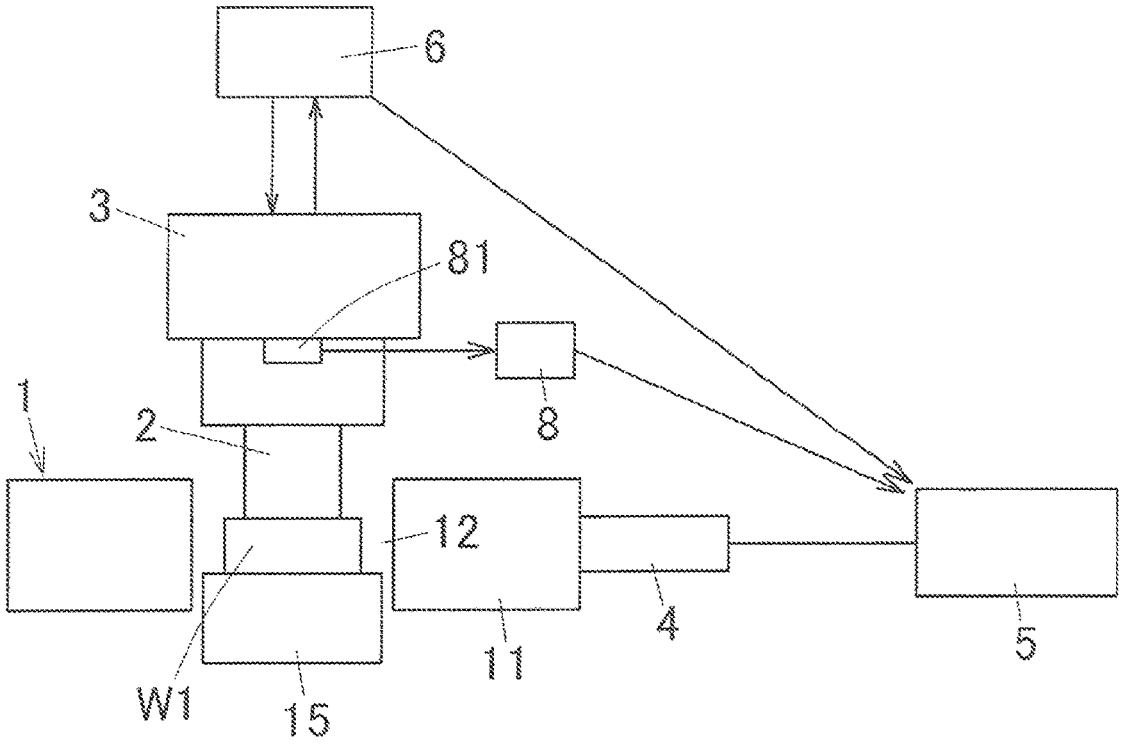
FIG. 11 is a block diagram showing a forging apparatus capable of executing a forging method according to a third embodiment of the present invention.

FIG. 11 is a block diagram showing a forging apparatus (forging die) capable of executing a forging method according to a third embodiment of the present invention. As shown in this figure, the forging apparatus is provided with a load detector 81 that detects a load of the punch 2 applied to the forging material W1, and a reference frequency changing means 8 that acquires a signal on the punch load from the load detector 81.

In the reference frequency changing means 8, a reference frequency changing load value obtained by the following method, etc., is set in advance. The reference frequency changing means 8 detects the load (punch load) of the punch 2 applied to the forging material W1 when the punch 2 is lowered based on the information from the load detector 81, and transmits a reference frequency changing signal to the ultrasonic vibration device 5 at the time when the punch load has reached the reference frequency changing load value.

The ultrasonic vibration device 5 that received the reference frequency changing signal changes the vibration frequency of the vibrator 4 by adjusting the vibrator driving electric power to change the vibration frequency to be applied to the die body 11. Thus, the reference frequency is changed and forging is performed.

On the other hand, when the forging is completed, application of the ultrasonic vibration is stopped. That is, the raising-and-lowering control device 6 detects the time when the shaping is completed based on the information from the raising-and-lowering driving mechanism 3. The ultrasonic vibration device 5 that received the shaping completion signal stops outputting to the vibrator 4. With this, the ultrasonic vibration of the die body 11 by the vibrator 4 is stopped.

Such forging is repeated, so that a forged article is produced sequentially.

In this embodiment, the reference frequency changing means 8 is constituted by a microcomputer, etc., and functions as a reference frequency changing device. Further, the load detector 81 functions as a load detecting apparatus.

In the forging apparatus according to the third embodiment, in the same manner as described above, the vibration may be stopped once immediately before changing the reference frequency.

<How to Obtain Reference Frequency Switching Load Value>

Next, a method for obtaining a reference frequency changing time will be described specifically.

Figure 12A:
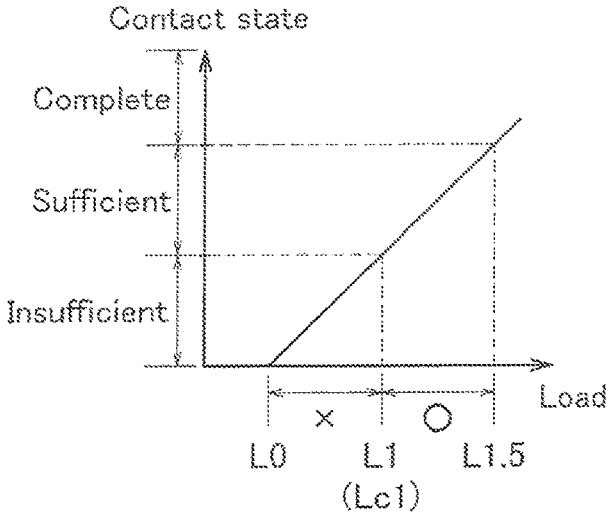
FIG. 12A is a graph showing a relation between a contact state of a forging material with respect to a shaping hole inner peripheral surface and a process elapsed time.
Figure 12B:
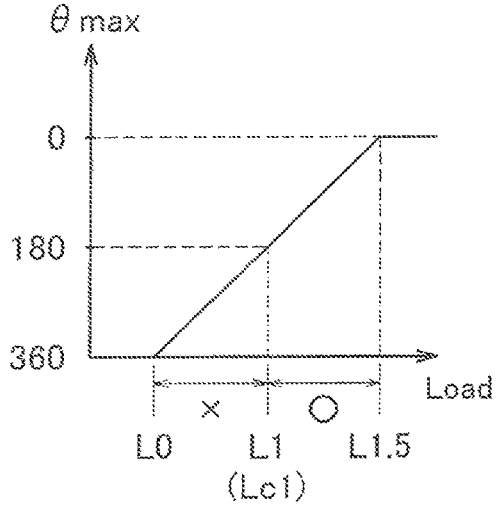
FIG. 12B is a graph showing a relation between a center angle maximum value θmax between contact points and a punch load.
Figure 12C:
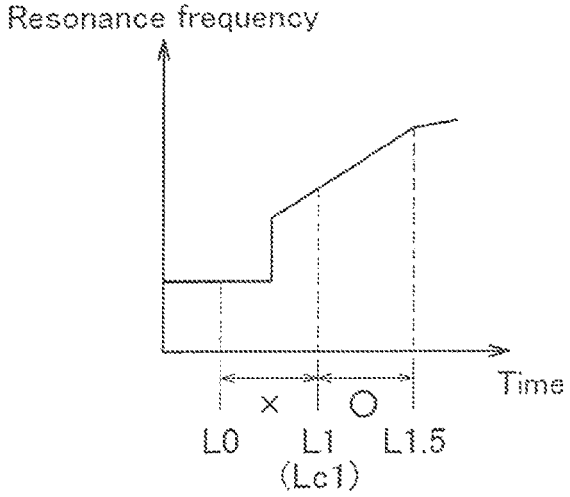
FIG. 12C is a graph showing a relation between a resonance frequency and a process elapsed time.

FIG. 12A is a graph showing a relation between a contact state of a forging material and a punch load. FIG. 12B is a graph showing a relation between a contact point center angle maximum value θmax and a punch load. FIG. 12C is a graph showing a relation between a resonance frequency and a punch load.

In these graphs, "L0" denotes a load value at the time when the punch 2 is lowered to start shaping, "L1" denotes a load value at the time when the forging material W1 shifts from the insufficient contact state with respect to the shaping hole inner peripheral surface (θmax>180 degrees) to the sufficient contact state (θmax≤180 degrees), and "L1.5" denotes a load value at the time when the forging material W1 shifts from the sufficient contact state with respect to the shaping hole inner peripheral surface to the insufficient contact state (θmax=180 degrees).

As will be understood from these graphs, since the resonance frequency changes in a discontinuously and immediately before reaching "L1" and the tracking range also shifts instantaneously, when it reaches L1" with the frequency at the time when it has not reached "L1" (range shown by "X" in the graph), the vibration frequency of the ultrasonic vibration device 5 deviates from the shifted tracking range, which prevents the vibration frequency from being converged to the resonance frequency. On the other hand, when the reference frequency is changed so as to fall within the shifted tracking range at the time after "L1" (in the range shown by "○" in the graph), the vibration frequency can be converged to the resonance frequency, which enables vibration in the resonant condition.

Considering these circumstances, it is understood that in the forging apparatus shown in FIG. 8, the reference frequency changing load value "Lc1" is set to "L1".

Initially, in this embodiment, in the forging apparatus shown in FIG. 11, the reference frequency changing load value "Lc1" is provisionally set to no load (0 kN) to start forging. In this forging, the time to change the reference frequency is too early, resulting in deviation of the vibration frequency from the tracking range, which prevents the vibration frequency from being converged to the resonance frequency. As a result, the vibration state becomes disordered to cause an overload error, which can be confirmed. Next, the provisionally set reference frequency changing load value "Lc1" is set to a value slightly higher than 0 kN, and forging is performed in the same manner to confirm that an overload error occurs. By repeating these operations, the provisionally set reference frequency changing load value "Lc1" is set to a gradually increased value, to experimentally find out the minimum load among loads that vibration state is not disturbed and no overload error occurs. The load value is considered as a qualified reference frequency changing load value "Lc1", and the load value "Lc1" is set to the forging apparatus shown in FIG. 8.

On the other hand, in the same manner as described, based on the time when the contact state of the forging material W1 with respect to the punch outer peripheral side surface shifts from an insufficient contact state to a sufficient contact state, a reference frequency changing time "Lc3" corresponding to "t3" of FIG. 3A can be decided. That is, the load value corresponding to a load value between "t1" and "t2" shown in FIG. 3A is provisionally set as the second reference frequency changing load value "Lc3", and forging is performed.

In this forging, the time to change the reference frequency is too early, resulting in large deviation of the vibration frequency from the tracking range, which prevents the vibration frequency from being converged to the resonance frequency. Next, the secondary set reference frequency changing load value "Lc3" is set to a value larger than the aforementioned provisionally set load value, and forging is performed in the same manner to confirm that an overload error occurs. By repeating these operations, the reference frequency changing load value "Lc3" to be previously set is set to a gradually increased value, to experimentally find out the minimum load among loads that vibration state is not disturbed and no overload error occurs. The load value is considered as a qualified second reference frequency changing load value "Lc3", and the load value "Lc3" is set to the forging apparatus shown in FIG. 11.

By performing forging as described above using the forging apparatus to which the first and second reference frequency changing load values "Lc1" and "Lc3 are set, the forging material can be vibrated assuredly in a resonant condition, which can assuredly attain the effects by ultrasonic vibration, such as, e.g., decrease of the shaping load and improvement of the shape transfer property.

In this embodiment, as the reference load values "Lc1" and "Lc3", the smallest loads causing no overload error are set, but not limited to it. In the present invention, as long as no overload error occurs, any load can be set to the reference load values "Lc1" and "Lc3".

In the forging method according to the third embodiment, since the time (time of changing the reference frequency) for shifting the contact state to a sufficient contact state based on the punch load is predicted, no influence is given by the change of the shaping speed of the forging material W1. For this reason, the forging method according to the third embodiment can predict the time for changing the reference frequency with a high degree of accuracy as compared with a forging method according to the second embodiment in which the changing time is predicted from the process elapsed time. As a result, an occurrence of an overload error can be prevented more assuredly, and decreasing of the shaping load and improvement of the shape transfer property can be attained more assuredly.

In the ultrasonic forging, it is preferable to perform the frequency change at as an early stage as possible. Therefore, in the forging method according to the third embodiment capable of accurately grasping the time for shifting to a sufficient contact state, the reference frequency can be accurately changed at as an earlier stage as possible. From this point of view, the aforementioned effects can be obtained more assuredly The forging method according to the present invention can be applied to a forging apparatus, etc., that performs forging using ultrasonic vibration.

It should be understood that the terms and expressions used herein are used for explanation and have no intention to be used to construe in a limited manner, do not eliminate any equivalents of features shown and mentioned herein, and allow various modifications falling within the claimed scope of the present invention.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive.

DESCRIPTION OF REFERENCE SYMBOLS

1: die
11: die body
12: shaping hole
2: punch
4: vibrator (vibration application apparatus)
5: ultrasonic vibrator (vibration application apparatus)
7, 8: reference frequency changing means (reference frequency changing device)
81: load detector (load detecting apparatus)
f1: tracking range
fr, fr0 to fr4: resonance frequency
fs0, fs1, fs3: reference frequency
Lc1: resonance frequency changing load value
Lt1: reference frequency changing time
t0: shaping start time
W1: forging material

What is claimed is:

1. A forging method comprising:

setting a forging material in a shaping hole of a die body;

pressing the forging material with a punch to perform plastic shaping of the forging material;

applying ultrasonic vibration having a reference frequency as an initial value of a vibration frequency to the die body with a vibration applying apparatus during the plastic shaping of the forging material; and converging the vibration frequency to a resonance frequency of the die body during the plastic shaping of the forging material when the vibration frequency is within a tracking range of the vibration applying apparatus, wherein when the tracking range is shifted in accordance with a discontinuous change of the resonance frequency during the plastic shaping of the forging material to deviate from the vibration frequency, the reference frequency is changed so as to fall within a shifted tracking range, wherein the forging material is extruded rearward so as to be filled into a punch outer peripheral gap between a punch outer peripheral side surface and a shaping hole inner peripheral surface of the die body during the plastic shaping of the forging material, wherein a contact state of the forging material with respect to the punch outer peripheral side surface changes during a process that the forging material is being filled in the punch outer peripheral gap from an insufficient contact state to a sufficient contact state, and wherein the reference frequency is changed after shifting of the contact state of the forging material with respect to the punch outer peripheral side surface from the insufficient contact state to the sufficient contact state.

2. The forging method as recited in claim 1, wherein a contact state of the forging material with respect to a shaping hole inner peripheral surface of the die body changes during the plastic shaping of the forging material from an insufficient contact state to a sufficient contact state, and wherein the reference frequency is changed after shifting of the contact state of the forging material with respect to a shaping hole inner peripheral surface of the die body from the insufficient contact state to the sufficient contact state.

3. The forging method as recited in claim 1, further comprising:

obtaining a punch load at a time of shifting of a contact state of the forging material with respect to a shaping hole inner peripheral surface of the die body from an insufficient contact state to a sufficient contact state; and determining a time of changing the reference frequency based on the obtained punch load.

4. The forging method as recited in claim 1, further comprising:

obtaining a time of shifting of the contact state from the insufficient contact state to the sufficient contact state based on an elapsed time from a start time of the plastic shaping of the forging material by the punch; and determining a time of changing the reference frequency based on the obtained time.

5. The forging method as recited in claim 1, further comprising:

obtaining a punch load at a time of shifting of the contact state from the insufficient contact state to the sufficient contact state; and determining a time of changing the reference frequency based on the obtained punch load.

6. A forging method comprising:

setting a forging material in a shaping hole of a die body;

pressing the forging material with a punch to perform plastic shaping of the forging material;

applying ultrasonic vibration having a reference frequency as an initial value of a vibration frequency to the die body with a vibration applying apparatus during the plastic shaping of the forging material;

converging the vibration frequency to a resonance frequency of the die body during the plastic shaping of the forging material when the vibration frequency is within a tracking range of the vibration applying apparatus, wherein when the tracking range is shifted in accordance with a discontinuous change of the resonance frequency during the plastic shaping of the forging material to deviate from the vibration frequency, the reference frequency is changed so as to fall within a shifted tracking range;

obtaining a time of shifting a contact state of the forging material with respect to a shaping hole inner peripheral surface of the die body from an insufficient contact state to a sufficient contact state based on an elapsed time from a start time of the plastic shaping of the forging material by the punch; and determining a time of changing the reference frequency based on the obtained time.

7. A forging method comprising:

setting a forging material in a shaping hole of a die body;

pressing the forging material with a punch to perform plastic shaping of the forging material;

applying ultrasonic vibration having a reference frequency as an initial value of a vibration frequency to the die body with a vibration applying apparatus during the plastic shaping of the forging material; and converging the vibration frequency to a resonance frequency of the die body during the plastic shaping of the forging material when the vibration frequency is within a tracking range of the vibration applying apparatus, wherein when the tracking range is shifted in accordance with a discontinuous change of the resonance frequency during the plastic shaping of the forging material to deviate from the vibration frequency, the reference frequency is changed so as to fall within a shifted tracking range, and wherein application of vibration by the vibration applying apparatus is stopped immediately before changing the reference frequency, and the application of vibration by the vibration applying apparatus is restarted when the reference frequency is changed.

* * * * *